US012502038B2

(12) United States Patent
Kim

(10) Patent No.: US 12,502,038 B2
(45) Date of Patent: Dec. 23, 2025

(54) SITTING TOILET HAVING FOOT HEALTH CARE DEVICE ATTACHED THERETO

(71) Applicant: Deok Woo Kim, Seoul (KR)

(72) Inventor: Deok Woo Kim, Seoul (KR)

( * ) Notice: Subject to any disclaimer, the term of this patent is extended or adjusted under 35 U.S.C. 154(b) by 323 days.

(21) Appl. No.: 18/024,186

(22) PCT Filed: Jul. 27, 2021

(86) PCT No.: PCT/KR2021/009740
§ 371 (c)(1),
(2) Date: Mar. 1, 2023

(87) PCT Pub. No.: WO2022/050573
PCT Pub. Date: Mar. 10, 2022

(65) Prior Publication Data

US 2023/0329490 A1 Oct. 19, 2023

(30) Foreign Application Priority Data

Sep. 2, 2020 (KR) ..... 10-2020-0111951

(51) Int. Cl.
*A47K 4/00* (2006.01)
*A47K 3/062* (2006.01)

(52) U.S. Cl.
CPC ..... *A47K 4/00* (2013.01); *A47K 3/062* (2013.01)

(58) Field of Classification Search
CPC ..... A47K 4/00; A47K 3/06; A47K 3/062
USPC .... 4/420, 428, 254, 464, 465, 664, 622, 902
See application file for complete search history.

(56) References Cited

U.S. PATENT DOCUMENTS

| | | | | | |
|---|---|---|---|---|---|
| 2,274,739 | A * | 3/1942 | Rast | ..... | A61H 35/006 4/622 |
| 2005/0081292 | A1* | 4/2005 | Lev | ..... | A61H 35/006 4/622 |
| 2018/0020889 | A1 | 1/2018 | Hall et al. | | |

FOREIGN PATENT DOCUMENTS

| | | | | | |
|---|---|---|---|---|---|
| CN | 002846560 | Y | | 12/2006 | |
| CN | 106691262 | A | | 5/2017 | |
| CN | 108612163 | A | | 10/2018 | |
| CN | 109339172 | A | | 2/2019 | |
| CN | 110974645 | A | | 4/2020 | |
| JP | 07-216967 | A | | 8/1995 | |
| JP | 2007222279 | A | * | 9/2007 | ..... A47K 17/028 |
| KR | 20-0384264 | Y1 | | 5/2005 | |
| KR | 10-2006-0117512 | A | | 11/2006 | |

(Continued)

OTHER PUBLICATIONS

International Search Report of PCT/KR2021/009740 dated Nov. 11, 2021 [PCT/ISA/210].

*Primary Examiner* — Tuan N Nguyen
(74) *Attorney, Agent, or Firm* — Sughrue Mion, PLLC

(57) ABSTRACT

A sitting toilet has a foot health care device attached thereto. The sitting toilet contains: a main body having a receiving part in the lower front-end portion and a portion of the lower rear end; and a foot health care device mounted in the receiving part of the main body and capable of being expandably adjusted according to an operation of a user. The main body may include: a toilet bowl formed across the upper front-end portion and rear portion, and having a sewage discharge port on a center line (the center line connecting the front and rear of the sitting toilet); and a sewage discharge unit connected to the sewage discharge port of the toilet bowl and eccentrically disposed so as to diverge from the center line so as to discharge sewage to the outside.

19 Claims, 27 Drawing Sheets

(56) References Cited

FOREIGN PATENT DOCUMENTS

| | | | | |
|---|---|---|---|---|
| KR | 10-1848744 | B1 | 4/2018 | |
| WO | WO-2018014844 | A1 * | 1/2018 | ..... A47K 3/006 |

* cited by examiner

--Prior Art--

--Prior Art--

A-A'

B-B`

170`

F-F'

F-F'

SITTING TOILET HAVING FOOT HEALTH CARE DEVICE ATTACHED THERETO

CROSS REFERENCE TO RELATED APPLICATIONS

This application is a National Stage of International Application No. PCT/KR2021/009740, filed Jul. 27, 2021, claiming priority to Korean Patent Application No. 10-2020-0111951, filed Sep. 2, 2020.

TECHNICAL FIELD

The present disclosure relates to a sitting toilet, and particularly, to a sitting toilet having a foot health care device attached thereto.

BACKGROUND ART

A sitting toilet in which a person sits and relieves himself or herself as if the person sits on a chair is also called a toilet bowl or a toilet seat, and is one of the essential goods which are very frequently used and play important roles in daily life.

The sitting toilet has a form in which a person can sit on the sitting toilet, and may be used in relation to a rest or washing even if a person does not relieve himself or herself because the sitting toilet is basically installed in the bathroom at home. To the present day, there is no example in which an additional function has been commercialized and used in addition to a function related to the discharge of the bowels, such as the washing of private parts.

Meanwhile, a behavior that is important and that is frequently performed in the bathroom in daily life is the washing of a foot. A foot is likely to be dried or become rough because the foot produces three times more sweat than other body parts and has almost no sebaceous gland. If the foot is not properly managed, there is a risk for various types of foot diseases, such as athlete's foot.

In particular, when pandemic viruses are raging or air pollution is severe due to fine dust these days, a person must keep his or her foot clean after returning home in order to keep his or her health.

In general, when washing his or her foot, he or she bends his back so that his or her hands can reach his or her foot, and wipes every corner of the foot with his or her hands. However, a herniated disk patient or a pregnant woman who has a difficulty in taking this behavior, the old and the infirm who have a bad balance, etc. may have a great difficulty in autonomously washing their feet because they feel uncomfortable with such a movement itself, and are not free from a safety problem, such as slipping.

Accordingly, there was a case in which a foot health care device, such as a conventional foot washing device, is placed around a sitting toilet that plays a role as a chair so that a user can safely wash his or her feet or the foot health care device is used by being attached to the sitting toilet. However, the foot health care device is still some way off in terms of effectiveness because several unnecessary problems including drainage treatment remain.

Accordingly, if the sitting toilet is produced as one product by receiving the foot health care device in a lower part of the sitting toilet, foot health can be managed very conveniently. A common sitting toilet has many difficulties in coupling the foot health care device to the lower part of the sitting toilet because the space of the lower part is not sufficient.

As illustrated in FIGS. 1 and 2, a common sitting toilet 1 includes a toilet bowl 2, a wastewater outlet 2*a* of the toilet bowl, a trap 3, an external wastewater pipe connection part 3*a* connected to a wastewater outlet 5 of a bathroom floor, etc. The common sitting toilet has an advantage in that the common sitting toilet is convenient upon fabrication because the entire structure thereof is symmetrical on the basis of a left and right center line, but has a problem in that, if a foot washing device is additionally attached, the common sitting toilet has a narrow space where a related device will be installed because the trap 3 and the external wastewater pipe connection part 3*a* are disposed in a central part of the toilet bowl 2 at the bottom thereof.

DISCLOSURE

Technical Problem

The present disclosure has been proposed to solve the aforementioned problems, and an object of the present disclosure is to provide a sitting toilet having a receiving space secured so that a foot health care device having foot washing and foot bath functions can be easily attached to a lower part of a main body.

In particular, the present disclosure is to provide a sitting toilet, which can secure a receiving space for a foot health care device by disposing the trap and the external wastewater pipe connection part of the existing toilet (in the present disclosure, the trap and the external wastewater pipe connection part are integrated as a "wastewater discharge unit" construction), which were symmetrically disposed bilaterally in a center line that connects the front and rear of a main body, with an eccentricity from side to side, and connecting the trap and the external wastewater pipe connection part to a toilet bowl.

Objects to be achieved by the present disclosure are not limited to the aforementioned objects, and the other objects not described above may be evidently understood from the following description by those skilled in the art.

Technical Solution

A sitting toilet according to an embodiment of the present disclosure includes a main body having a receiving part in parts of a bottom of the main body at a front thereof and the bottom of the main body at a rear thereof and a foot health care device held in the receiving part of the main body and capable of being unfolded and adjusted in response to a user's manipulation.

In this case, the main body includes a toilet bowl formed across the top of the main body at the front thereof and a rear part of the main body and including a wastewater outlet on a center line (a center line that connects the front and rear of the sitting toilet) and a wastewater discharge unit connected to the wastewater outlet of the toilet bowl, eccentrically disposed away from the center line, and configured to discharge wastewater to the outside.

In this case, the wastewater discharge unit includes a trap connected to the wastewater outlet of the toilet bowl and disposed in an eccentric direction away from the center line and an external wastewater pipe connection part connected to the trap, disposed in the same eccentric direction as the trap away from the center line, and configured to discharge wastewater to the outside.

Meanwhile, another main body according to the present disclosure includes a toilet bowl formed across the top of the main body at the front thereof and a rear part of the main body and including a wastewater outlet that is eccentrically disposed on any one of left and right sides on the basis of a center line (a center line that connects the front and rear of the center of the sitting toilet) and a wastewater discharge unit connected to the wastewater outlet of the toilet bowl, eccentrically disposed on the same side as the wastewater outlet of the toilet bowl, and configured to discharge wastewater to the outside.

In this case, the wastewater discharge unit includes a trap connected to the wastewater outlet of the toilet bowl and eccentrically disposed from the center line on the same side as the wastewater outlet of the toilet bowl, and an external wastewater pipe connection part connected to the trap, eccentrically disposed on the same side as the wastewater outlet of the toilet bowl, and configured to discharge wastewater to the outside.

Meanwhile, the foot health care device according to the present disclosure includes a foot washing bowl, a user input unit, and a driving unit. The foot washing bowl has an inside space in which user's feet are placed and a wastewater outlet at the bottom thereof.

The user input unit is provided outside the foot washing bowl, and displays an operating state of the foot health care device and provides various types of function buttons. The driving unit unfolds and adjusts the foot washing bowl forward and backward in response to an instruction signal from the user input unit.

The unfolding or holding of the foot washing bowl may be implemented by using a sliding method of moving the foot washing bowl back and forth (forward and backward), a folding method of folding and unfolding the foot washing bowl, or a method of combining the sliding method and the folding method.

First, in the case of the sliding method, the foot health care device is slid and adjusted to the front and rear of the main body from the receiving part of the main body, so that the inside space of the foot washing bowl in which the user's feet are placed is opened and closed.

Next, in the case of the folding method, the foot health care device is folded and held in the receiving part of the main body, and may be rotatably moved and unfolded and adjusted to the front and rear of the main body in response to a user's manipulation. In this case, the foot health care device includes a foot washing bowl having an inside space in which the user's feet are placed; a user input unit configured to provide various types of function buttons; and a driving unit configured to unfold and adjust the foot washing bowl forward and backward in response to an instruction signal from the user input unit. The foot washing bowl is set by default so that the foot washing bowl is folded and held in the receiving part of the main body, and may be slid and moved and rotatably moved and unfolded and adjusted to the front and rear of the main body in response to a user's manipulation.

In this case, the foot washing bowl may be configured so that an internal box is maintained in the state in which the internal box has been folded within an external box that forms an outward appearance of the foot washing bowl when the foot washing bowl is held in the receiving part of the main body and the external box is rotatably moved, seated in a floor, and then forward moved horizontally, so that the internal box moves upward from the external box when the foot washing bowl is unfolded to the front of the main body.

In this case, if necessary, a connection part of a rubber material having elasticity may be airtightly provided between the internal and external boxes. The internal and external boxes may include variable wall bodies elastically deformed in accordance with a bottom of the toilet bowl at portions being in contact with the bottom of the toilet bowl when the foot washing bowl is held in the receiving part of the main body and fixing wall bodies disposed at portions not being contact with the bottom of the toilet bowl and airtightly connected to both ends of the variable wall body.

An outer wall configured to airtightly protect a moving section of the foot washing bowl and support the front of the main body may be disposed at both ends of the receiving part of the main body.

An inner wall may be disposed inside the receiving part of the main body. Bad smell can be blocked from being introduced from the wastewater outlet of a bathroom floor to a room by sealing the bottom of the inner wall and the bathroom floor.

At least one support provided so that the foot washing bowl forms horizontality with the floor may be provided at the bottom of the foot washing bowl.

The foot health care device includes a spray unit configured to spray predetermined washing water toward an inside space of the foot washing bowl, a foot detection sensor configured to detect locations of the user's feet which are placed in the inside space of the foot washing bowl, and a control unit configured to adjust a spray angle of the spray unit based on the locations of the user's feet, which are detected in the foot detection sensor.

In this case, the foot health care device may further include an air bubble generator disposed at the bottom of the foot washing bowl and configured to generate air bubbles toward the sole of the user. In this case, it is preferred that the spray unit sprays the washing water in the state in which the air bubble generator has been turned on.

The foot washing bowl of the foot health care device may further include a toe washing unit configured to wash toes of the user placed in the inside space.

The toe washing unit includes a toe spray nozzle configured to spray the washing water between the toes of the user and a washing member attached to the outside of the toe spray nozzle and configured to remove contaminants between the toes of the user.

The spray unit includes one or more side spray nozzles disposed in an inner circumferential surface of the foot washing bowl and configured to spray water laterally and an upward spray nozzle installed at a bottom of the foot washing bowl and configured to spray water upward. In this case, a nozzle disposed at a front end, among the side spray nozzles, is disposed to be higher than a nozzle disposed at a rear end, among the side spray nozzles.

The spray unit may further include a downward spray nozzle configured to spray water toward an inner floor of the foot washing bowl, a cleaning solution nozzle disposed inside the foot washing bowl and configured to spray a cleaning solution, and a spray valve connected between the downward spray nozzle and the cleaning solution nozzle and capable of selectively adjusting the spray of the downward spray nozzle and the cleaning solution nozzle.

The foot health care device may further include a heel washing unit rotatably installed at a rear end of the foot washing bowl therein and configured to wash a heel of the user.

In this case, it is preferred that the heel washing unit is disposed to have a predetermined inclination along a shape of the heel of the foot.

To this end, the heel washing unit includes a rotation member connected to the rear end of the foot washing bowl therein in a width direction or length direction thereof and having a rotatable structure, a detachable type brush having a structure surrounding the rotation member and including an external surface having a rough surface, and an actuator configured to rotate the rotation member by the control unit.

The heel washing unit may include a location adjustment part configured to adjust a location of the rotation member by the control unit.

Meanwhile, the foot health care device needs to use the wastewater pipe of the sifting toilet or a separate sewage duct in order to discharge wastewater of the foot washing bowl. To this end, the foot health care device may further include a wastewater discharge unit disposed between an outlet and the wastewater outlet of the bathroom floor.

In this case, the wastewater outlet of the bathroom floor may be a wastewater outlet for the sifting toilet, which treats wastewater of the sitting toilet or may be a wastewater outlet for sewage treatment, which treats sewage. In general, it is preferred that wastewater is discharged to the wastewater outlet for the sifting toilet because only the wastewater outlet for the sifting toilet is present in the bathroom floor of a space under the sifting toilet. In this case, the wastewater discharge unit may be formed in a form in which only a part of the wastewater pipe of the main body is deformed.

That is, the wastewater discharge unit may include a wastewater inlet pipe connected to the wastewater outlet of the foot washing bowl, a wastewater discharge pipe connected to the wastewater outlet of the bathroom floor, and a smell blocking unit having a U shape and disposed between the wastewater inlet pipe and the wastewater discharge pipe and configured to block smell that is introduced from the wastewater outlet of the bathroom floor.

Advantageous Effects

According to the present disclosure, a restriction problem with a space can be solved because the foot health care device is attached to a lower part of the sitting toilet at the front thereof in a folding type. In particular, the present disclosure can provide even effectiveness and convenience by adopting both automatic and manual folding methods for the foot health care device.

The foot health care device of the present disclosure can wash toes in the foot washing bowl and can discharge wastewater of the foot washing bowl to the wastewater outlet of a bathroom floor without the introduction of smell.

Accordingly, according to the foot health care device attached to the sitting toilet according to the present disclosure, a foot washing and a foot bath are possible in a very pleasant environment because a user can conveniently discharge wastewater without having to worry about the inflow of stink while cleanly washing his or her toes.

Furthermore, the present disclosure can provide even convenience and practicality by constructing the cover of the sitting toilet so that a user can use the cover as a chair.

Furthermore, the foot health care device attached within the sitting toilet of the present disclosure has a structure in which a user can evenly wash the sole and toes of his or her foot even without using his or her hand and bending the waist of the user. Accordingly, even a disabled person who has a restricted movement can conveniently wash his or her feet and perform and a foot bath.

MODE FOR INVENTION

Advantages and characteristics of the present disclosure and a method for achieving the advantages and characteristics will become apparent from the embodiments described in detail later in conjunction with the accompanying drawings. However, the present disclosure is not limited to the disclosed embodiments, but may be implemented in various different forms. The embodiments are merely provided to complete the present disclosure and to fully notify a person having ordinary knowledge in the art to which the present disclosure pertains of the category of the present disclosure. The present disclosure is merely defined by the claims. Terms used in this specification are used to describe embodiments and are not intended to limit the present disclosure. In this specification, an expression of the singular number also includes an expression of the plural number unless clearly defined otherwise in the context. The term "comprises" and/or "comprising" used in this specification does not exclude the presence or addition of one or more other components, steps, operations and/or elements in addition to mentioned components, steps, operations and/or elements Hereinafter, preferred embodiments of the present disclosure are described in detail with reference to the accompanying drawings. As a basic structure of a sitting toilet according to the present disclosure follows a common sitting toilet, a description of a structure itself of the sitting toilet that has been already known is omitted for better understanding and convenience of description, and a foot health care device attached to the sitting toilet and a structure in which the foot health care device has been attached to the sitting toilet and an operation thereof are chiefly described and illustrated in detail.

Figure 3:
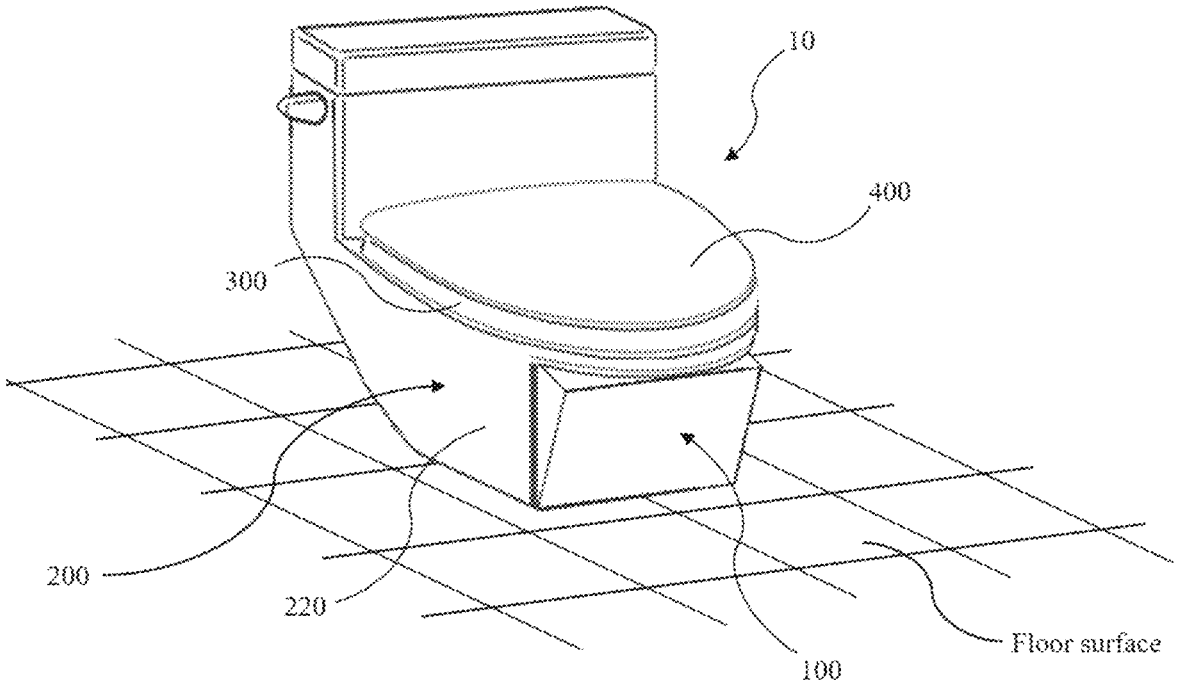
FIG. 3 is a diagram schematically illustrating a sitting toilet to which a foot health care device according to an embodiment of the present disclosure has been attached.
Figure 4:
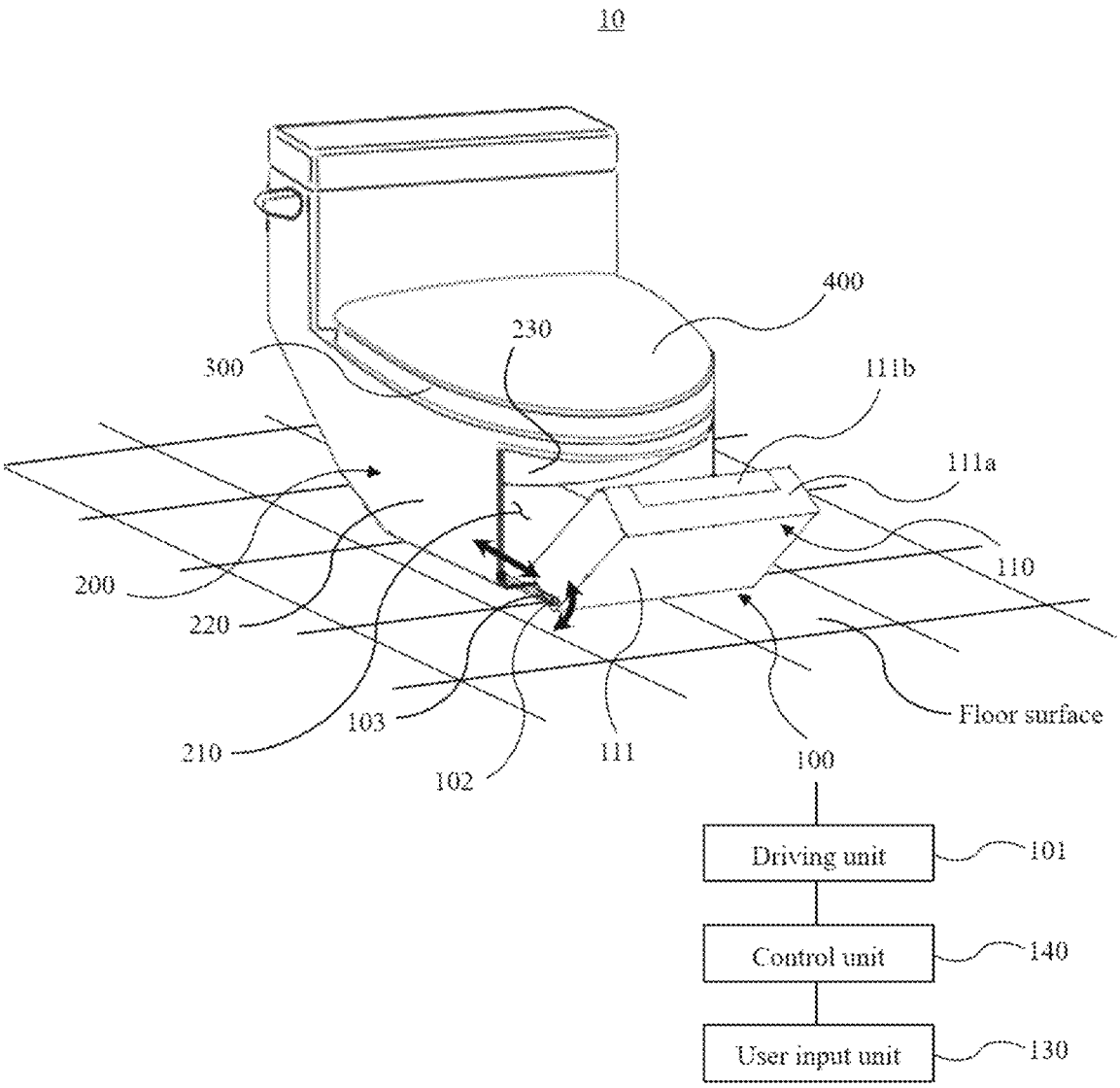
FIGS. 4 to 6 are diagrams sequentially illustrating an example of an operation of the sitting toilet to which the foot health care device according to an embodiment of the present disclosure has been attached.
Figure 5:
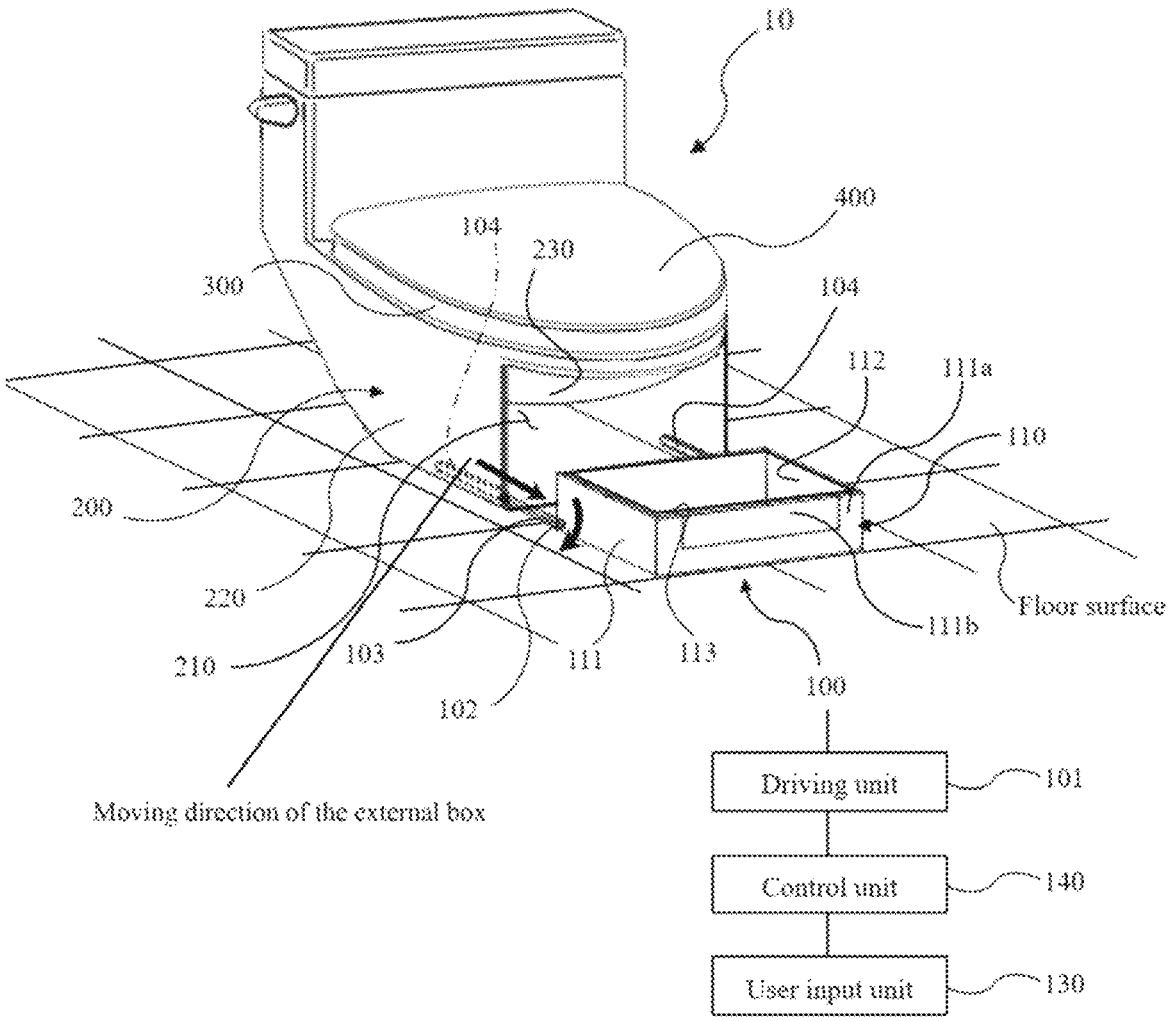
Figure 6:
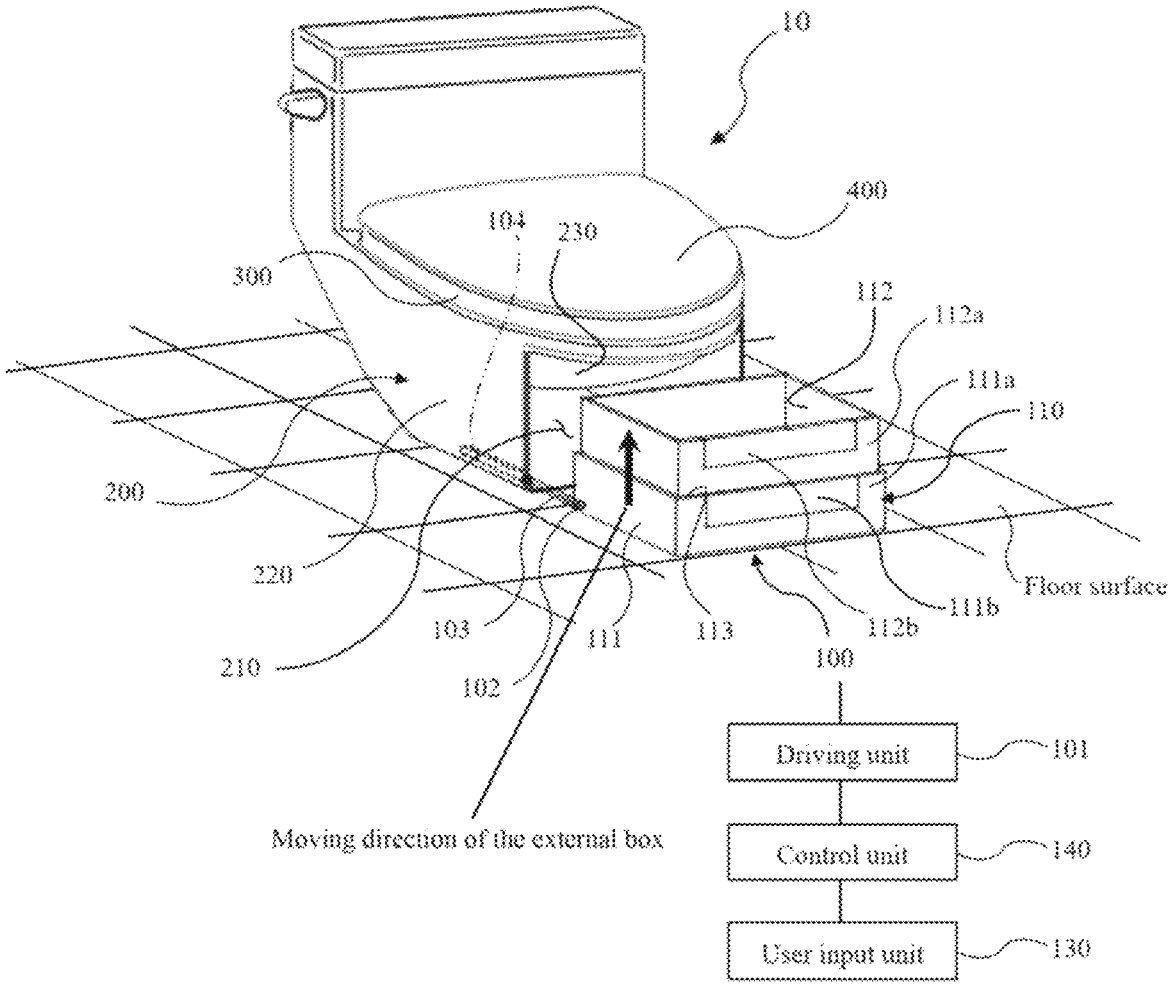

FIG. 3 is a diagram schematically illustrating a sitting toilet to which a foot health care device according to an embodiment of the present disclosure has been attached. FIGS. 4 to 6 are diagrams sequentially illustrating an example of an operation of the sitting toilet to which the foot health care device according to an embodiment of the present disclosure has been attached.

As illustrated in FIGS. 3 to 6, a sitting toilet 10 according to an embodiment of the present disclosure has a structure in which a foot health care device 100 has been attached in a folding type.

The sitting toilet 10 includes a main body 200 that forms a general frame, a seat 300, and a cover 400.

A receiving part 210 is formed at the bottom of the main body 200 at the front of the main body at a lower part thereof. The receiving part 210 is a receiving space in which the foot health care device 100 can be received, and has a size in which a foot washing bowl 110 of the foot health care device 100 can be received. A toilet bowl 230 is installed in a section including the top of the main body 200 at the front and rear sides thereof and the bottom of the main body at the rear thereof.

An outer wall 220 for airtightly protecting a rotation section of the foot washing bowl 110 and supporting the main body 200 may be disposed at both ends of the receiving part 210 of the main body 200. The outer wall 220 may be formed along with the main body 200 in an integrated type in the state in which the outer wall has been disposed outside the foot washing bowl 110 or may be formed in a separated type.

In this case, the outer wall 220 is formed in a form in which the outer wall supports the front end of the main body 200 against a floor by surrounding both ends of the foot washing bowl 110, and thus distributes weight applied to the front end of the main body 200 when a user sits on the sitting toilet 10. Accordingly, the outer wall 220 can previously block the possibility that the outer wall may be damaged by the weight that is applied to the front end of the sitting toilet 10. A shielding structure that is shielded by separate finishing materials (e.g., silicon or concrete) is provided between the bottom of the outer wall and a bathroom floor.

The foot health care device 100 is basically folded and held in the receiving part 210 of the main body 200, and may be unfolded and adjusted forward and backward in response to a user's manipulation.

The foot health care device 100 includes a foot washing bowl 110, a user input unit 130, a driving unit 101, and a control unit 140.

An electronic part capable of driving the foot health care device 100 may be airtightly embedded in the foot washing bowl 110. The foot washing bowl 110 includes a substrate in which a circuit that integrates and connects various cables or wires is installed, various parts connected to the substrate, etc.

The foot washing bowl 110 basically has a space in which feet are placed on the inside thereof, and has a form in which the top of the foot washing bowl is opened. The foot washing bowl 110 has a structure in which the foot washing bowl can be seated in the receiving part 210 of the main body 200, and has a structure in which the foot washing bowl can be opened and closed while being rotatably moved to the front and rear of the sitting toilet 10 from an opened surface of the main body 200.

At least one support (not illustrated) may be provided at the bottom of the foot washing bowl 110 so that the foot washing bowl 110 forms horizontality along with the floor. The height of the support and the height of the bottom of the foot washing bowl 110 and a floor surface may be identical with each other, or the height of the support may be relatively higher than the height of the bottom of the foot washing bowl and the floor surface.

The support is rotatably embedded in the foot washing bowl 100 in the state in which the foot washing bowl 110 has been folded in the main body 200, and may protrude and operate to support the foot washing bowl 110 in the state in which the foot washing bowl 110 has been placed on the floor in order to use the foot washing bowl. Alternatively, the support may be constructed in a detachable type, and may be constructed to be attached to or separated from the foot washing bowl 110, if necessary.

The user input unit 130 is installed outside the foot washing bowl 110, and displays an operating state of the apparatus and provides various types of function buttons. The user input unit 130 may be previously set in several types.

The driving unit 101 functions to adjust the foot washing bowl 110 forward and backward in response to an instruction signal from the user input unit 130. The driving unit 101 may have a structure in which the foot washing bowl slides and moves by electricity through an electric linear actuator (not illustrated) and/or a folding structure in which an electric cylinder (not illustrated) is connected to the foot washing bowl 110 and the foot washing bowl is rotatably unfolded. As still another example, a user may manually open and close the foot washing bowl 110 from the main body 200 in a way that the foot washing bowl is assembled into and/or detached from the main body.

The control unit 140 is a component capable of generally integrating and controlling the apparatus, and controls an operation of the apparatus, which is suitable for a corresponding function, when a button having the corresponding function in the user input unit 130 is pressed in response to a user's manipulation instruction.

Next, an operation relation between components of the sitting toilet 10 is described sequentially with reference to FIGS. 3 and 4 to 6.

FIGS. 4 to 6 are diagrams illustrating an embodiment for describing the receiving and unfolding structure of the sitting toilet 10 and the foot health care device 100. As illustrated, a hinge shaft 102, a connecting rod 103, and a rail 104 are disposed between the side of the receiving part 210 of the main body 200 on the inside thereof and the side of the foot washing bowl 110 on the outside thereof.

The hinge shaft 102 is installed on the side of the foot washing bowl 110 on the outside thereof. The connecting rod 103 is connected between the hinge shaft 102 and the rail 104. The rail 104 is disposed on the side of the receiving part 210 of the main body 200 on the inside thereof. In this case, the electric linear actuator of the driving unit 101 may be connected to the rail 104 so that the connecting rod 103 is horizontality moved or may be coupled to the connecting rod 103 so that the connecting rod is horizontally moved on the rail 104.

Furthermore, the driving unit 101 may include a separate electric cylinder between the foot washing bowl 110 and the inside of the receiving part 210 of the main body 200, and may drive the foot washing bowl 110 so that the foot washing bowl 110 is folded into the receiving part 210 of the main body 200 and unfolded from the receiving part 210 of the main body 200 centering around the hinge shaft 102.

A basic driving mechanism is as follows.

Figure 1:
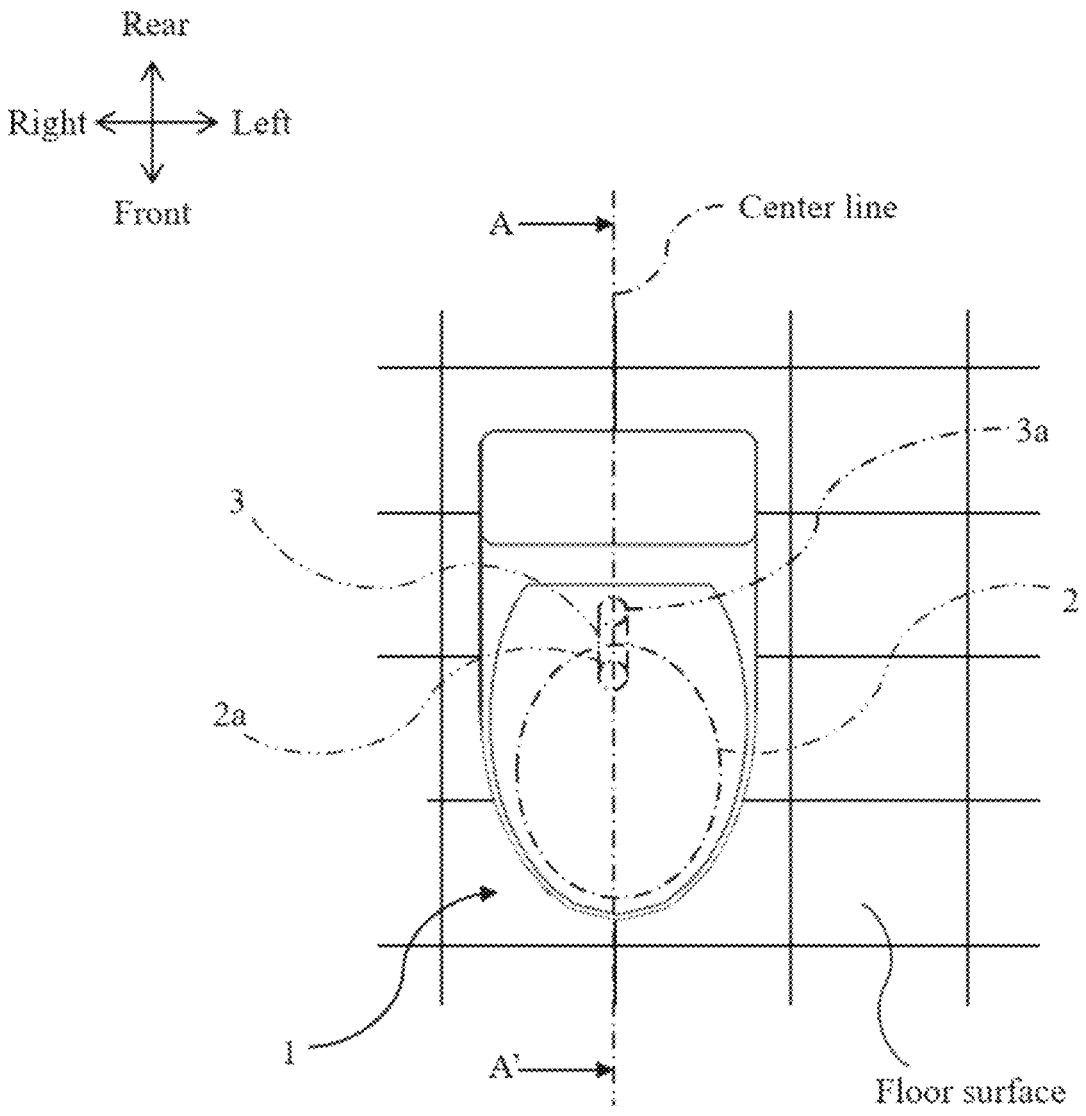
FIG. 1 is a plan view schematically illustrating a conventional sitting toilet.

At normal times, that is, when the foot health care device 100 is not used, as illustrated in FIG. 1, the foot health care device 100 is received in the main body 200. When the foot washing bowl 110 is received in the receiving part 210 of the main body 200, the foot washing bowl 110 is maintained in the state in which an internal box 112 has been folded within an external box 111 that forms an outward appearance. A connection part 113 of a rubber material having elasticity may be airtightly provided between the internal box 112 and the external box 111. The connection part 113 is constructed to be folded between the internal box 112 and the external box 111 when the internal box 112 is folded within the external box 111.

Upon operation, when an operation signal is input through the user input unit 130 from a user who attempts to use the foot health care device 100, the control unit 140 interprets the operation signal and transmits a driving instruction to the driving unit 101, so that the foot health care device is unfolded from the main body 200.

First, as illustrated in FIG. 3, the foot health care device 100 starts to rotatably move centering around the hinge shaft 102 and is horizontality placed on the floor. Next, as illustrated in FIGS. 4 and 5, the foot health care device 100 is moved forward on the rail 104 by a predetermined distance and is horizontally moved. A location at which the foot health care device 100 has been moved forward is a location at which a user can have his or her feet conveniently placed when seated in the toilet.

Next, as in FIG. 6, after the external box 111 is seated on the floor, the internal box 112 moves up to a predetermined height upward from the external box 111. The internal box 112 and the external box 111 are airtightly maintained by the connection part 113 so that washing water does not leak between the internal box 112 and the external box 111. In the illustrated example, the foot washing bowl 110 has a structure in which the internal box 112 and the external box 111 have been folded in two stages, but this is merely an example. The foot washing bowl 110 may also have a structure that has been folded in a plurality of n stages.

When the foot washing bowl 110 is held in the receiving part 210 of the main body 200, variable wall bodies 111*b* and 112*b* may be provided at portions at which the internal box 112 and the external box 111 are in contact with the bottom of the toilet bowl 230.

The variable wall bodies 111*b* and 112*b* may be made of a rubber material which may be elastically deformed. In this case, the rubber material includes natural rubber and synthetic rubber. Among the natural rubber and the synthetic rubber, the rubber material may be formed in one form of silicon, urethane, and latex.

In particular, latex is a material having a form in which fine polymer particles are dispersed in an aqueous solution, and may have better availability depending on its usage and environment because latex is one of materials that are widely used.

Accordingly, the variable wall bodies 111*b* and 112*b* may be elastically deformed suitably for an outward appearance of the bottom of the toilet bowl 230 when the foot washing bowl 110 is held in the receiving part 210 of the main body 200 (when the foot washing bowl 110 is placed inside the front part of the main body).

In this case, fixing wall bodies 111*a* and 112*a* are placed at portions that are not in contact with the bottom of the toilet bowl 230 at both ends of the variable wall bodies 111*b* and 112*b*.

Meanwhile, when a rotation operation of the foot washing bowl 110 of the foot health care device 100 is repeatedly performed on the receiving part 210 of the main body 200, there is a danger of concern that a contact portion between the foot washing bowl 110 and the receiving part 210 may be worn out because an impact is applied to the contact portion. Accordingly, the main body 200 may include a buffering part (not illustrated) for reducing the impact at a portion at which the main body 200 is in contact with the rear end of the foot washing bowl 110.

In the drawings, the cover 400 of the sitting toilet according to the present disclosure does not seem to be different from the existing cover. However, in order to provide convenience when a user uses the foot health care device 100, the cover 400 of the present disclosure may be made in the form of a chair that is rotatably moved by a rotation shaft (not illustrated) and that has a back support (not illustrated).

For example, the cover 400 of the sitting toilet has a structure in which two folds are overlapped. Onefold that is disposed on a lower part of the cover is made as a basic seat (not illustrated) in which a user can sit, and the other fold that is disposed on an upper part of the cover is made as a back support.

In this case, the basic seat may include a seat groove (not illustrated) that is depressed and formed in a section in which the user sits. When the back support overlaps the basic seat, the back support may have a shape and size corresponding to the seat groove.

That is, the back support is maintained in a horizontal state when inserted into the seat groove, and is maintained in a vertical state in which a user's back is in contact with the back support, when the back support is detached from the seat groove and rotatably moved in the radius of about 90 degrees. A rotation operation between the back support and the basic seat may be based on a user's manual manipulation or may be automatically performed through a separate button (not illustrated) function.

A cushion (not illustrated) of a waterproof material may be disposed between the back support and the seat groove. Such a cushion may be made in a replacement type in which the cushion can be selectively mounted and detached between the back support and the seat groove.

Figure 7:
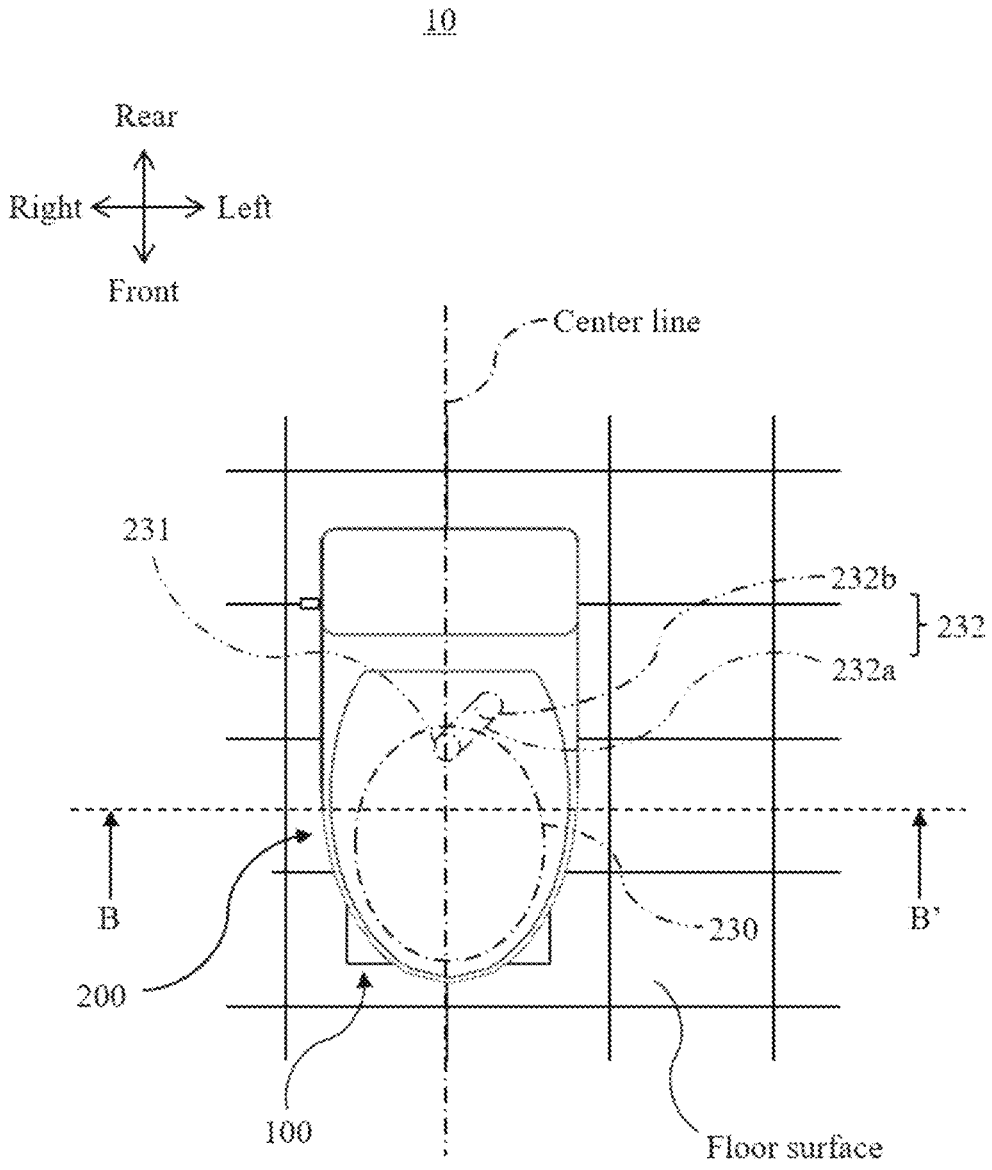
FIG. 7 is a plan view schematically illustrating a wastewater discharge unit of the sitting toilet according to an embodiment of the present disclosure.
Figure 8:
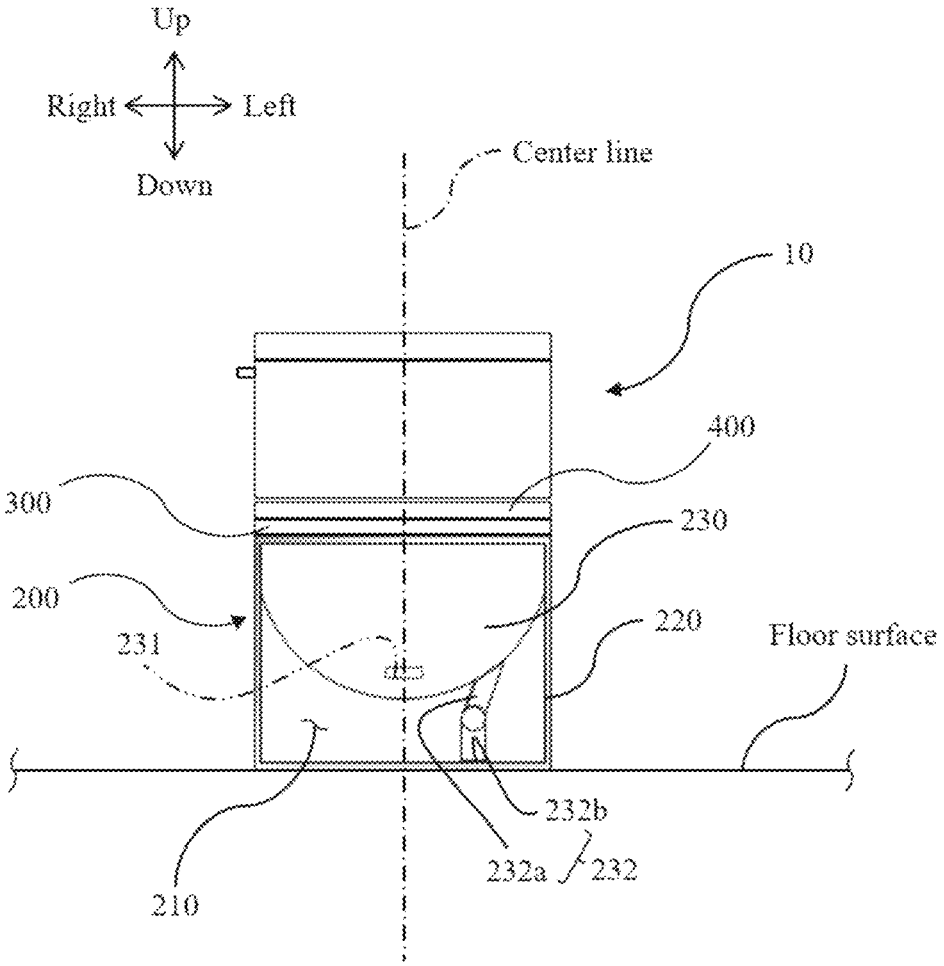
FIG. 8 is a front view illustrating a cross section taken along line B-B' in FIG. 7.

FIG. 7 is a plan view schematically illustrating a wastewater discharge unit of the sitting toilet according to an embodiment of the present disclosure. FIG. 8 is a front view illustrating a cross section taken along line B-B' in FIG. 7.

Figure 2:
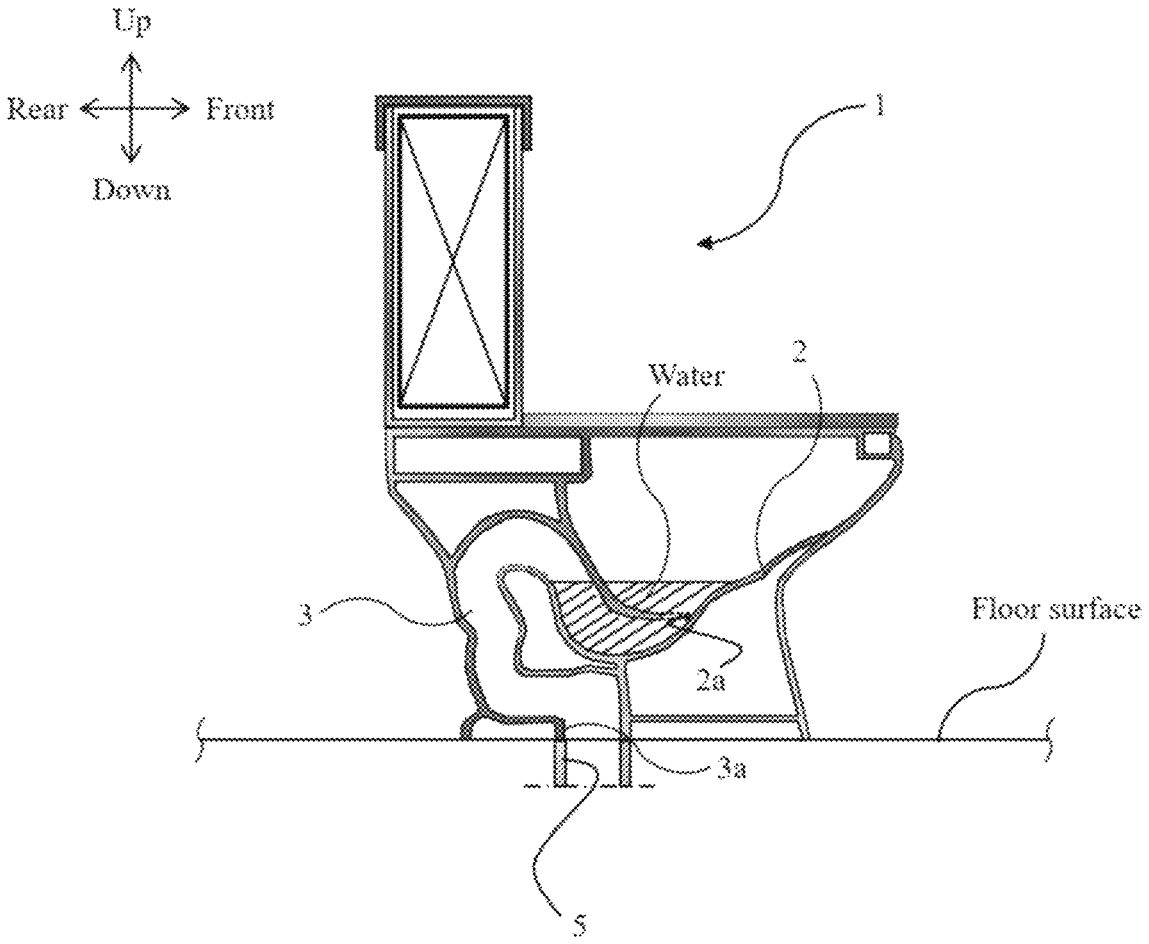
FIG. 2 is a side view of the conventional sitting toilet illustrating a cross section taken along line A-A' in FIG. 1.

Prior to a description of FIG. 7, in order to help understanding of structural characteristics of the wastewater discharge unit according to the present disclosure, the structure of the conventional sitting toilet (FIGS. 1 and 2) is described. The conventional sitting toilet has a symmetrical structure on the basis of a center line thereof, and a portion at which the trap connected to the sitting toilet and the wastewater outlet of a bathroom floor are connected is also formed to have a symmetrical structure.

In general, the trap adopts a siphon structure. Attempts are recently made to reduce the amount of water used by using a variable trap.

The conventional sitting toilet structure is commonly advantageous in terms of reduced costs along with manufacturing convenience, but has a disadvantage in that the conventional sitting toilet structure has a structural limit in installing a separate driving unit as in the present disclosure.

For example, if the trap has a left and right symmetrical structure on the basis of the toilet bowl, a space in which the driving unit may be installed under the toilet bowl is inevitably limited.

The sitting toilet 10 in FIGS. 7 and 8 presents a structure different from a conventional structure because a driving unit called the foot health care device 100 is installed in the receiving part 210 that forms a receiving space under at the bottom of the main body 200 at the front thereof.

That is, a wastewater discharge unit 232 that is connected between a wastewater outlet 231 of the toilet bowl 230 and a wastewater outlet (5 in FIG. 11) of the bathroom floor is eccentrically disposed on any one of left and right sides on the basis of the center line of the toilet bowl 230.

As illustrated in FIG. 8, the wastewater discharge unit 232 is not disposed in a central space of the toilet bowl 230 thereunder within the receiving part 210. Accordingly, the conventional restriction problem with the space can be solved at low costs because the central space of the toilet bowl 230 thereunder can be used when a separate sliding device is designed or the installation of a related driving unit is considered.

In this case, the wastewater discharge unit 232 includes a trap 232*a* and an external wastewater pipe connection part 232*b*. The trap 232*a* has one end connected to the wastewater outlet 231 of the toilet bowl 230 so that the trap is eccentrically disposed on any one side within the receiving part 210 of the main body 200 on the basis of a center line of the toilet bowl 230 on the left and right sides thereof. The external wastewater pipe connection part 232*b* is formed at the other end of the trap 232*a*, and is connected to the wastewater outlet of the bathroom floor.

As described above, although the trap 232*a* is twisted toward any one of the left and right sides about 45 degrees on the basis of the center line of the toilet bowl 230, there is no problem with drainage. Furthermore, there is a structural advantage in that the structure of the wastewater discharge unit 232 can use a space to the maximum extent possible because a driving unit can be installed on the other side (an empty space within the receiving part 210) under the toilet bowl 230 in which the wastewater discharge unit 232 has not been installed.

Figure 9:
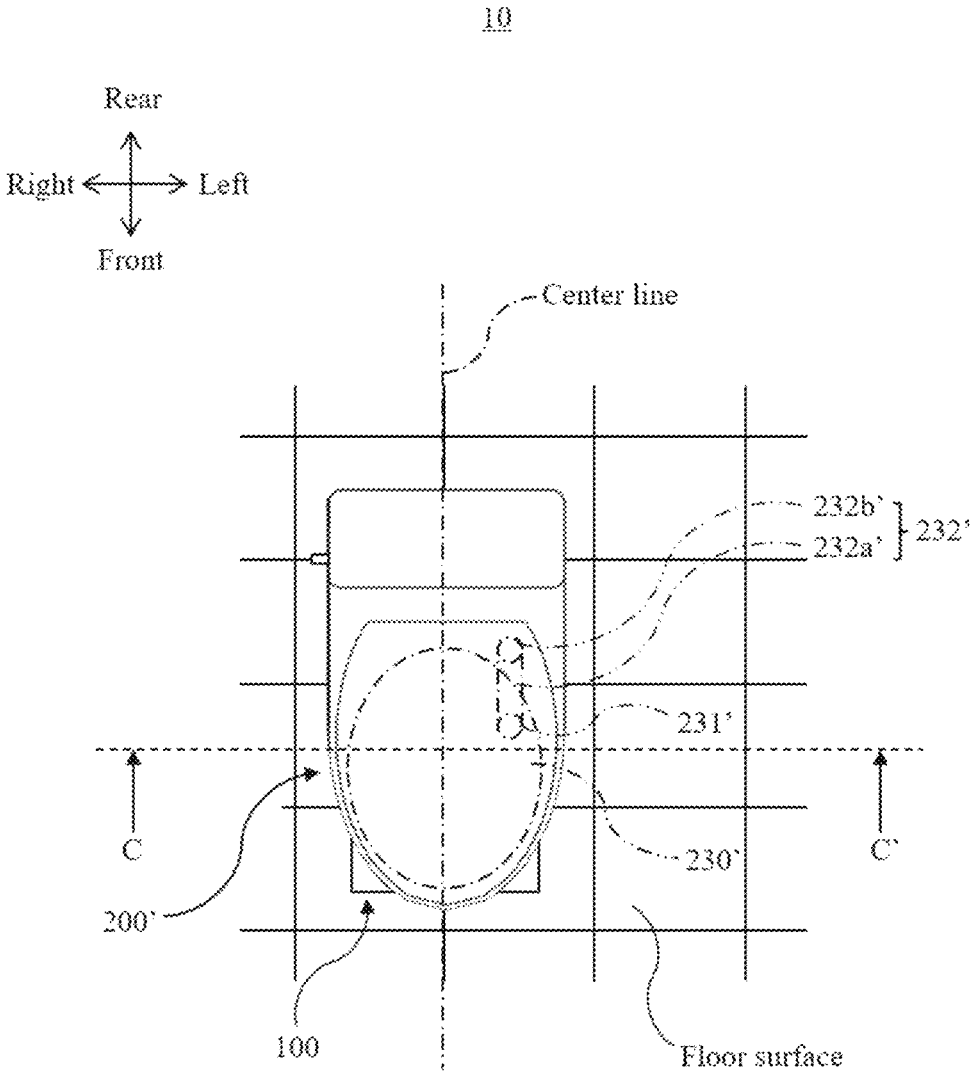
FIG. 9 is a plan view schematically illustrating a modified example of a toilet bowl and a wastewater discharge unit in a sitting toilet according to an embodiment of the present disclosure.
Figure 10:
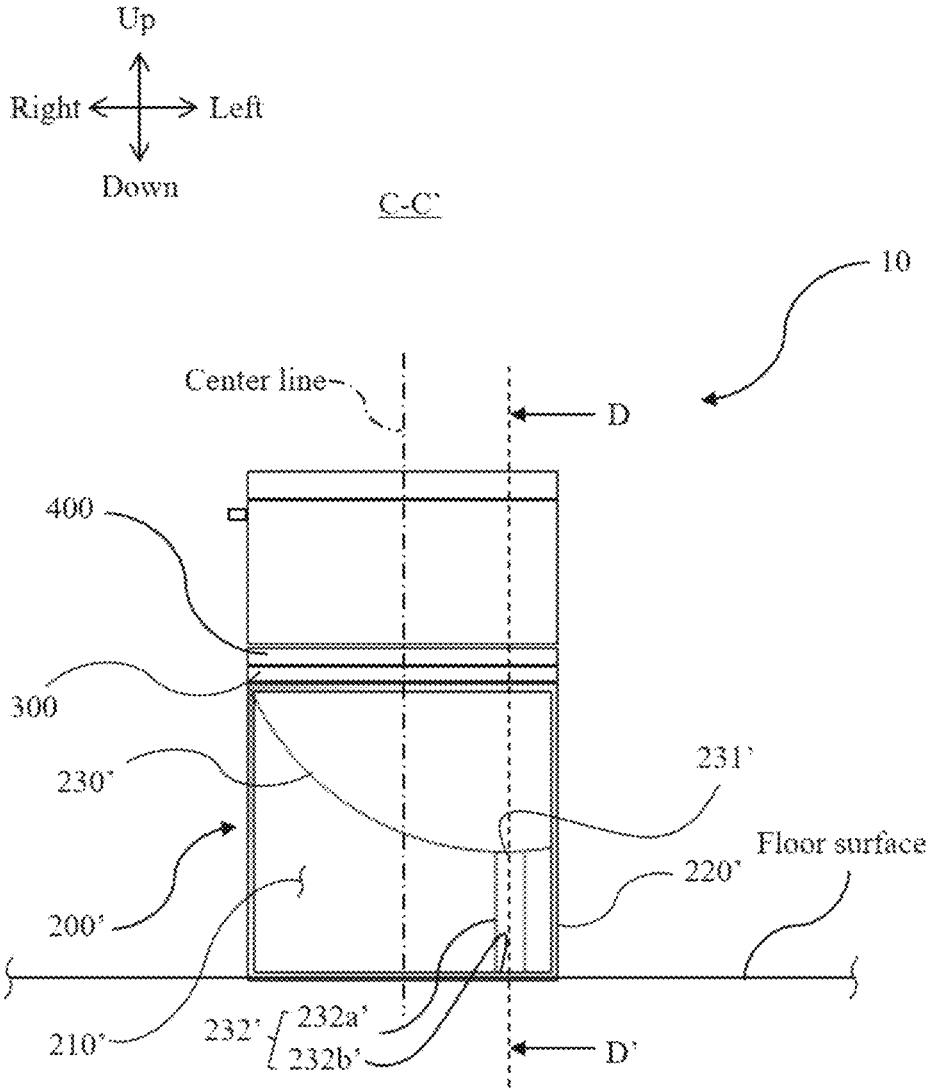
FIG. 10 is a front view illustrating a cross section taken along line C-C' in FIG. 9.
Figure 11:
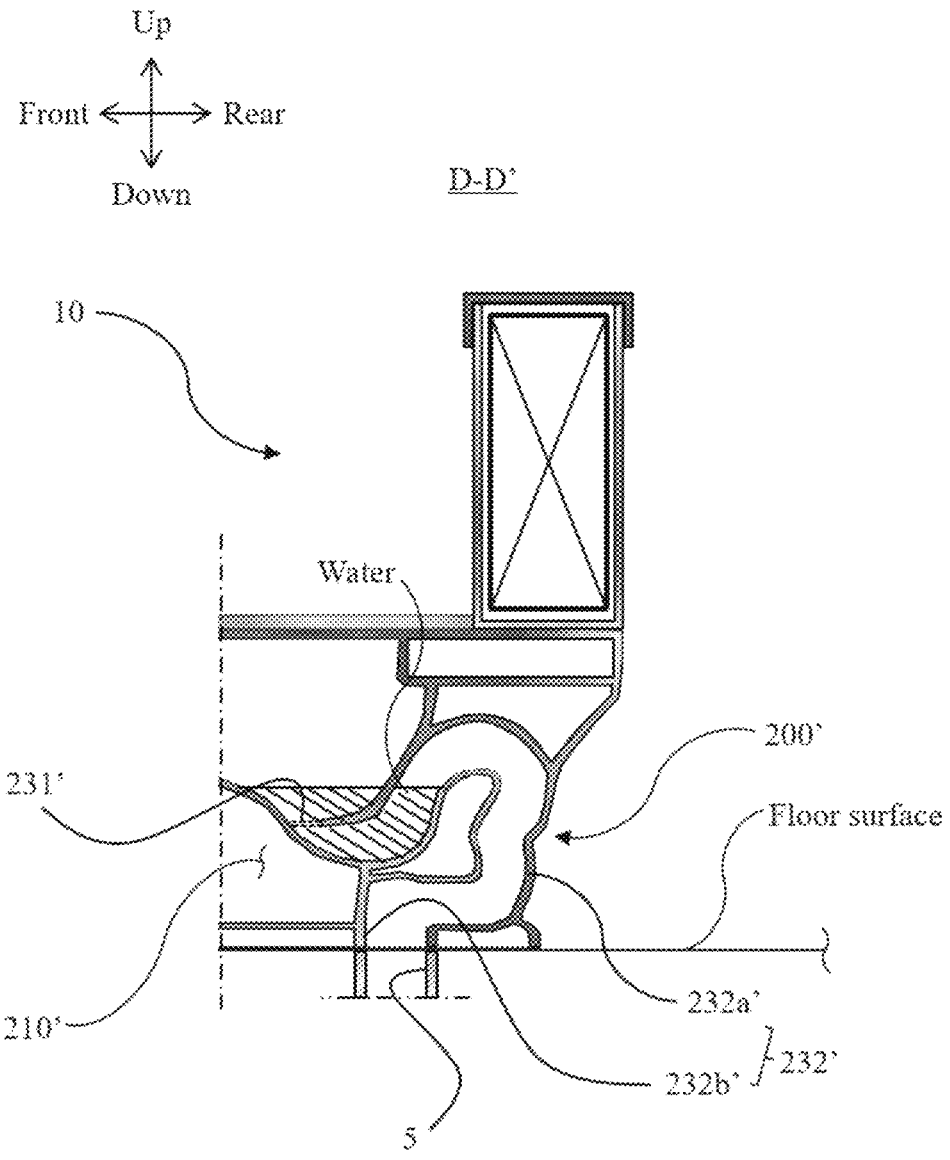
FIG. 11 is a partial side view illustrating a cross section taken along line D-D' in FIG. 10.

FIG. 9 is a plan view schematically illustrating a modified example of the toilet bowl and the wastewater discharge unit. FIG. 10 is a front view illustrating a cross section taken along line C-C' in FIG. 9. FIG. 11 is a partial side view illustrating a cross section taken along line D-D' in FIG. 10.

A wastewater discharge unit 232' and a toilet bowl 230' illustrated in FIGS. 9 to 11 have a structural characteristic in which a space where the foot health care device will be installed can be secured within a receiving part 210' according to the principle of FIGS. 7 and 8.

In this case, the toilet bowl 230' is eccentrically disposed to have a structure in which the toilet bowl has been downward inclined toward any one side on the basis of a center line of the sitting toilet 10 on the left and right sides thereof within the receiving part 210'. A wastewater outlet 231' is provided at the eccentric bottom of the toilet bowl 230'. The wastewater discharge unit 232' is disposed at the bottom of the toilet bowl 230', and discharges wastewater to the outside.

A trap 232*a'* of the wastewater discharge unit 232' has one end connected to the wastewater outlet 231' of the toilet bowl 230' so that the trap is eccentrically disposed toward the same side as the toilet bowl 230' within the receiving part 210' of the main body 200' on the basis of a center line of the toilet bowl 230' on the left and right sides thereof.

An external wastewater pipe connection part 232*b'* that is formed at the other end of the trap 232*a'* is connected to the wastewater outlet 5 of the bathroom floor.

Figure 12:
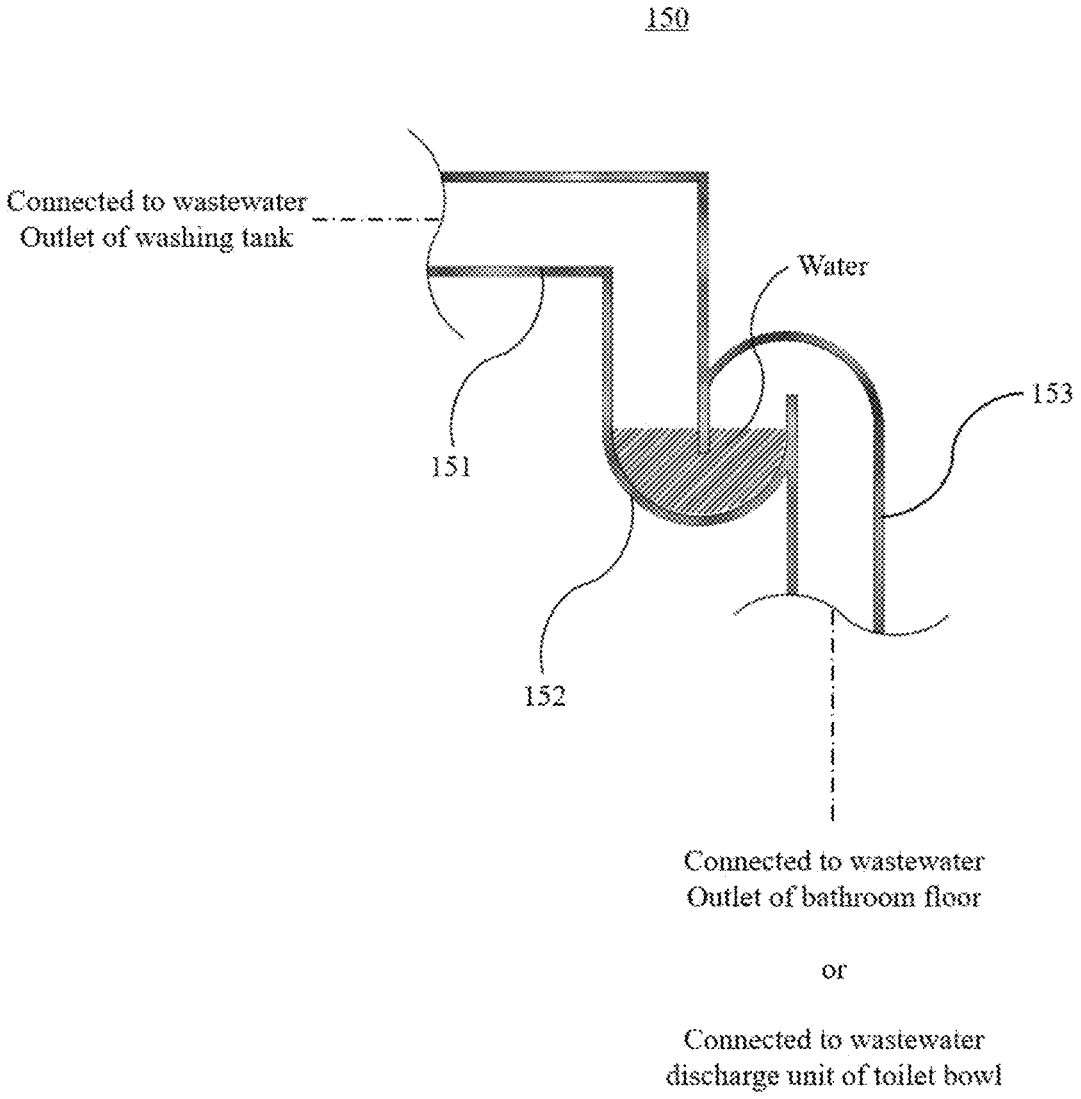
FIG. 12 is a cross-sectional view schematically illustrating a wastewater discharge unit of the foot health care device according to an embodiment of the present disclosure.

FIG. 12 is a cross-sectional view schematically illustrating a wastewater discharge unit of the foot health care device according to an embodiment of the present disclosure.

A wastewater discharge unit 150 illustrated in FIG. 12 includes a wastewater inflow pipe 151, a smell blocking unit 152, and a wastewater discharge pipe 153.

The wastewater inflow pipe 151 (a horizontal pipe at the front end of a U-shaped pipe) is connected to the wastewater outlet of the foot washing tank (110 in FIG. 4 to FIG. 6), and penetrates a connecting hole (not illustrated) of the main body (200 in FIG. 3 to FIG. 8, 200' in FIG. 9 to FIG. 11). In this case, the connecting hole is a hole through which the wastewater inflow pipe 151 can pass. Such a connecting hole may be formed in a section in which the wastewater discharge unit 150 is connected to the main body (200 in FIG. 3 to FIG. 8, 200' in FIG. 9 to FIG. 11)

The smell blocking unit 152 (the U-shaped pipe) is disposed between the wastewater inflow pipe 151 and the wastewater discharge pipe 153, and blocks the inflow of smell from the wastewater outlet of the bathroom floor. To this end, the smell blocking unit 152 may be implemented by using a U-shaped pipe or a dedicated valve in order to block the inflow of stink from the wastewater outlet of a bathroom floor.

The wastewater discharge pipe 153 (a vertical pipe in the rear of a U-shaped pipe) may have a front end connected to the smell blocking unit 152, and may have a rear end connected to the wastewater outlet of the bathroom floor or the trap of the toilet bowl.

In this case, the wastewater discharge unit 150 may be formed as an assembly in which the wastewater inflow pipe 151, the smell blocking unit 152, and the wastewater discharge pipe 153 are formed of separate parts, or the separate parts may be combined into one and integrally formed in the wastewater duct 201 of the main body 200.

Meanwhile, the wastewater discharge unit 150 may be included and implemented in a flange (not illustrated) that is used when the wastewater duct of the sitting toilet (10 in FIGS. 3 to 8) is combined with the wastewater outlet of a bathroom floor. For example, the wastewater discharge unit 150 may be implemented in an eccentric flange by deforming the eccentric flange so that the wastewater of the foot washing tank (110 in FIGS. 4 to 6) can be discharged.

The foot health care device (100 in FIGS. 3 and 9) fills the smell blocking unit 152 with water by periodically discharging clean water. This is for preventing wastewater from staying in the smell blocking unit 152 having the U-shaped form. It is better than the peripherals of the smell blocking unit 152 maintain an airtight state.

Figure 13:
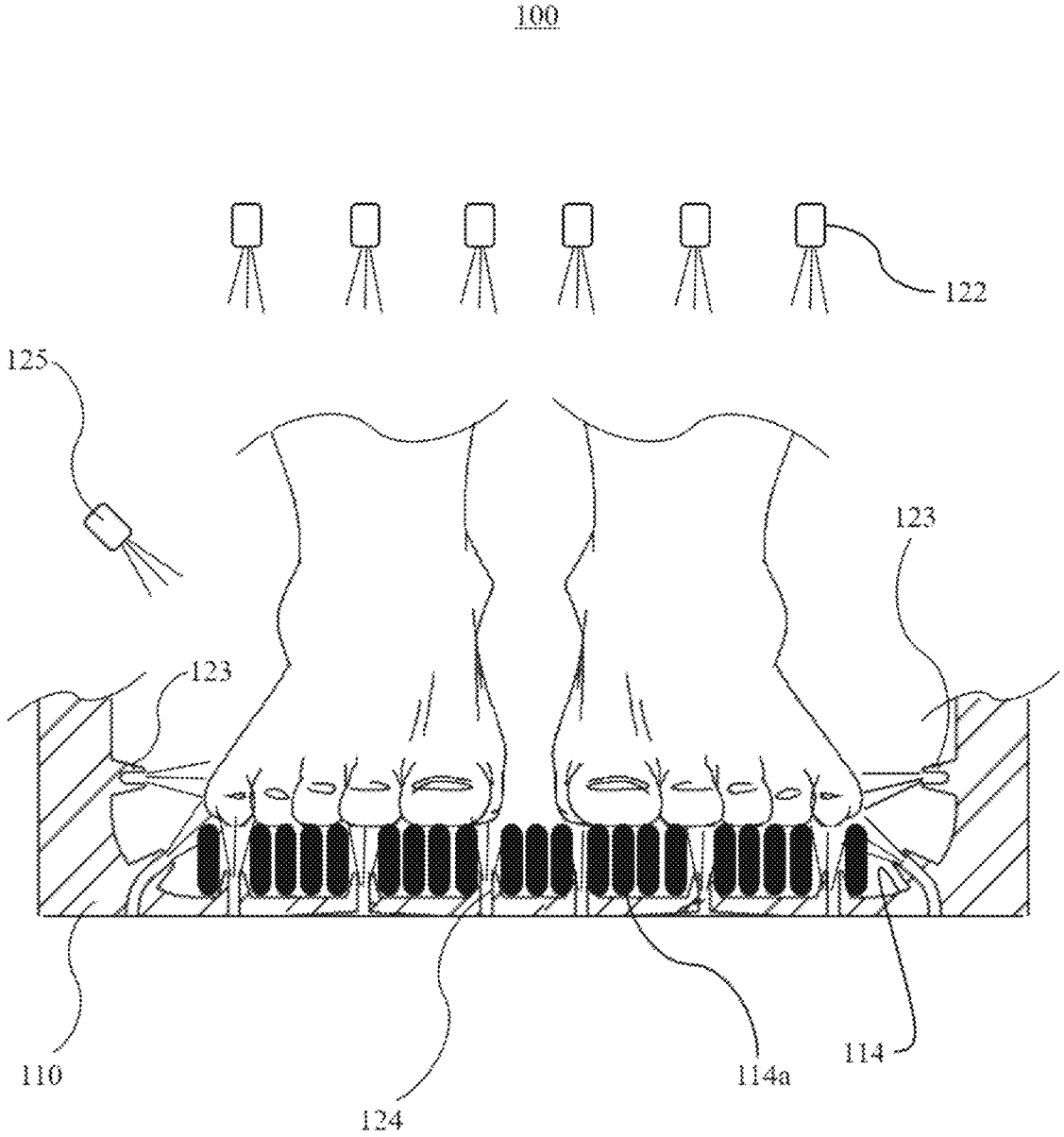
FIG. 13 is a cross-sectional exemplary view schematically illustrating an example of an operation of the foot health care device, from the front of the sitting toilet, in the sitting toilet having the foot health care device attached thereto according to an embodiment of the present disclosure.
Figure 14:
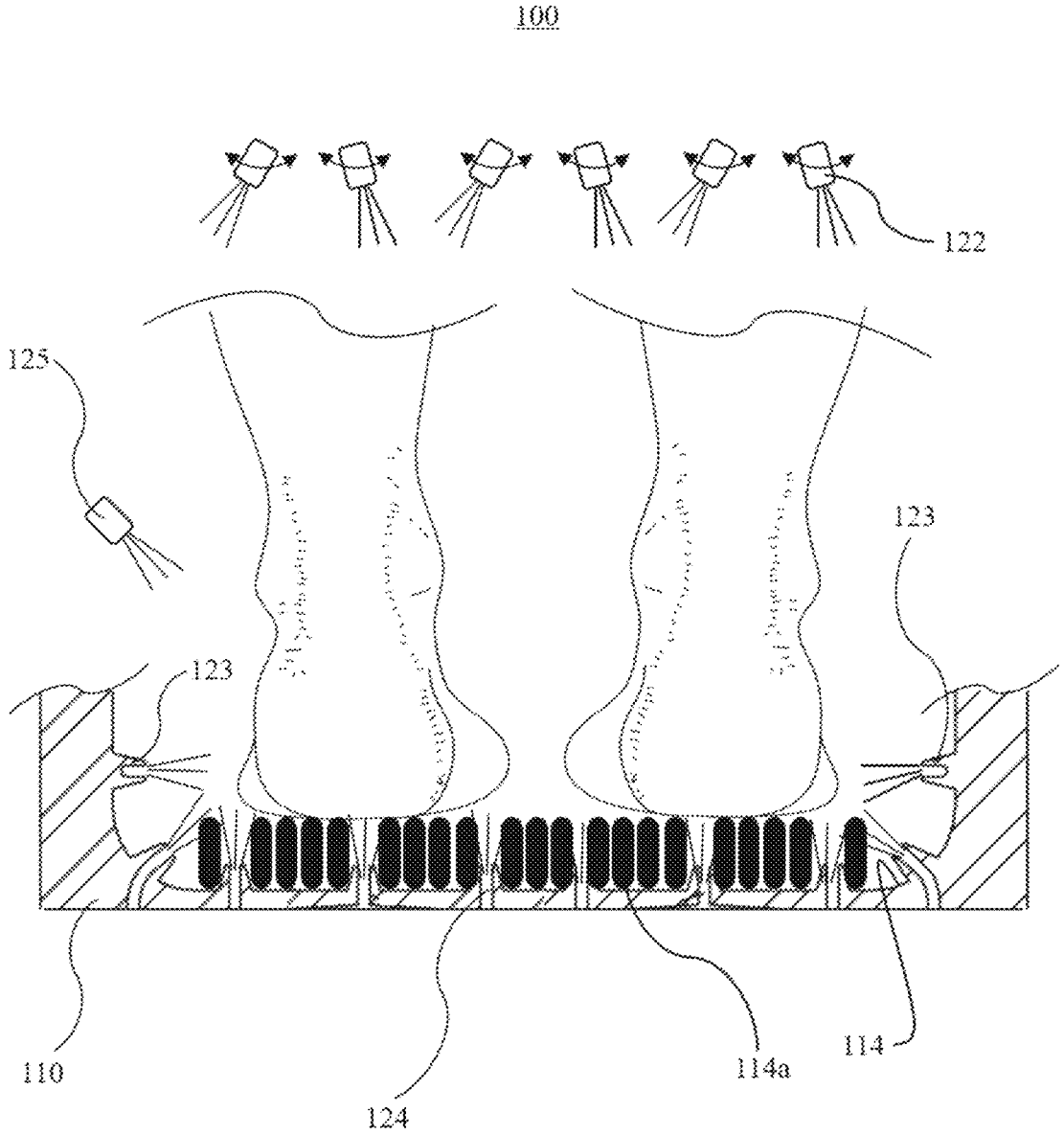
FIG. 14 is a cross-sectional exemplary view schematically illustrating an example of an operation of the foot health care device, from the back of the sitting toilet, in the sitting toilet having the foot health care device attached thereto according to an embodiment of the present disclosure.

FIGS. 13 and 14 are cross-sectional exemplary views schematically illustrating an example of an operation of the foot health care device according to an embodiment of the present disclosure from the front and rear of the foot health care device.

Referring to both FIGS. 13 and 14, the foot washing tank 110 has a structure in which the feet of a user are received therein. A washing plate 114 in which the feet of the user are placed is provided at the base plate of the foot washing tank 110.

The washing plate 114 is basically a plane, but may be deformed to include a central part (a portion at which the arch of a foot is placed) that upward protrudes.

A plurality of bumps 114*a* that upward protrude may be disposed in the washing plate 114 at intervals.

The bump 114*a* functions to help effectively wash the sole of a foot or to maintain a predetermined distance between a floor or a nozzle (an upward spray nozzle 154) that is formed at the bottom of the washing plate 114 and the foot. It is preferred that the bump 114*a* has a form that makes the sole feel a rough touch when the sole touches the bump, thus providing an acupressure effect, and that simultaneously allows the foot to be scrubbed.

Meanwhile, portions of the bumps 114*a* at which the foot is placed play a role as a frame that is elastically deformed or downward depressed to hold a shape of the foot, so that the foot can be stably seated in the washing plate 114.

The washing plate 114 has a structure in which the washing plate is detachable from the foot washing tank 110, and may be constructed to be replaced and used. Alternatively, unlike in the structure, the bumps are formed on the bottom surface of the foot washing tank 110, and thus the washing plate may be an area in which the foot is placed, that is, an area corresponding to the entire bottom surface of the foot washing tank 110 or a part of the bottom surface of the foot washing tank 110.

The foot washing tank cover (not illustrated) provides an area that prevents water from being splashed out by covering some section (front part) of the top of the foot washing tank 110 and in which downward spray nozzles 122 to be described later are installed.

The foot washing tank cover (not illustrated) may have a structure detachable from the foot washing tank 110, and may have a structure in which a hinge shaft (not illustrated) is rotatable by being connected to one side of the foot washing tank 110 at the front end thereof.

The spray unit 120 sprays washing water toward the inner space of the foot washing tank 110. The washing water is basically water, but may include a cleaning solution.

The spray unit 120 includes a side spray nozzle 123 and an upward spray nozzle 124, and may selectively include the downward spray nozzle 122 that is formed at the bottom of the foot washing tank cover.

One or more side spray nozzles 123 are disposed in the inner circumferential surface of the foot washing tank 110, and spray water laterally. Such a side spray nozzle 123 sprays water to a location that is lower than a horizontal direction at a location at which the side spray nozzle is installed on the inner wall of the foot washing tank 110.

The washing water is sprayed from the left and right inside the foot washing tank 110, so that the sole of a foot can be washed by twisting the ankle.

Meanwhile, the front end of the bottom of the foot washing tank 110 may be formed to be higher than the height of the rear end thereof, and the location of the side spray nozzle 123 toward the toes of a foot may be formed to be higher. In this case, the top of a foot and the toes of the foot can be more effectively washed because the direction of sprayed washing water becomes more perpendicular.

The upward spray nozzles 124 are disposed in the bottom surface of the washing plate 114 at an interval, and wash the sole of a foot by spraying water upward.

In this case, in relation to spray pressure of the upward spray nozzle 124, it is preferred that the height of the sprayed washing water is maintained within the height of the foot washing tank 110 in order to prevent the washing water from being splashed out of the foot washing tank 110. Alternatively, spray pressure of the upward spray nozzle 124 may be adjusted to be strong when the sole is washed, and the spray pressure may be adjusted to become weak immediately when it is detected that the foot is detached from the washing plate.

One or more downward spray nozzles 122 are disposed inside the cover, and spray washing water downward. If the downward spray nozzle 122 is additionally provided, it is effective to wash the top and toes of a foot.

A separate washing water supply unit (160 in FIG. 18) and/or a cleaning solution supply unit (not illustrated) that are disposed outside are connected to the spray unit 120. The supply of washing water is performed through an external water supply pipe. However, a water reservoir (not illustrated) for storing the washing water may be provided within the foot washing tank 110 in order to adjust spray pressure of the washing water. For example, when water pressure of the water supply pipe is higher than required water pressure, the water reservoir maintains proper spray pressure by playing a role as a buffer. If spray pressure of the washing water needs to be higher than water pressure of the water supply pipe, a piston (not illustrated) connected to the water reservoir operates to raise the spray pressure.

The cleaning solution supply unit may be supplied with a cleaning solution from an external cleaning solution supply device (not illustrated) or may be constructed in a cartridge replacement type. The cleaning solution supply unit is connected to a cleaning solution nozzle 125. As another embodiment, the cleaning solution supply unit may be connected to all of the nozzles of the spray unit 120 so that the nozzles of the spray unit 120 alternately spray washing water and a cleaning solution or mix and spray the washing water and the cleaning solution.

That is, the downward spray nozzle 122, the side spray nozzle 123, the upward spray nozzle 124, and the cleaning solution nozzle 125 may be connected by one pipe, and a spray valve (not illustrated) may be provided at each branched portion of the pipe, so that the washing water and/or the cleaning solution are selectively sprayed.

Alternatively, for convenience of a structure, only the downward spray nozzle 122 and the cleaning solution nozzle 125 may be connected by one pipe, and the spray valve may be disposed between the downward spray nozzle 122 and the cleaning solution nozzle 125, so that the washing water and/or the cleaning solution are selectively sprayed.

An operation of the spray unit 120 is controlled by the control unit (140 in FIGS. 4 to 6) in response to a user input through the user input unit (130 in FIGS. 4 to 6) or according to predetermined control logic.

In this case, it is preferred that in order to prevent water from being splashed out of the foot washing tank 110, the spray unit 120 sprays water in the state in which the foot washing tank 110 has been filled with a preset amount of water. In this case, the preset amount may be measured as a height that is preset by a user and at which the foot washing tank 110 is filled with washing water. The setting of the preset amount may be changed depending on an environment.

Spray pressure, a spray pattern, and a spray angle of the washing water and/or the cleaning solution that is sprayed by the spray unit 120 may be variously combined or controlled, and are described later.

The ON/OFF of power of the spray unit 120 may be differently displayed by an LED (not illustrated) that is electrically connected to the user input unit (130 in FIGS. 4 and 6).

Figure 15:
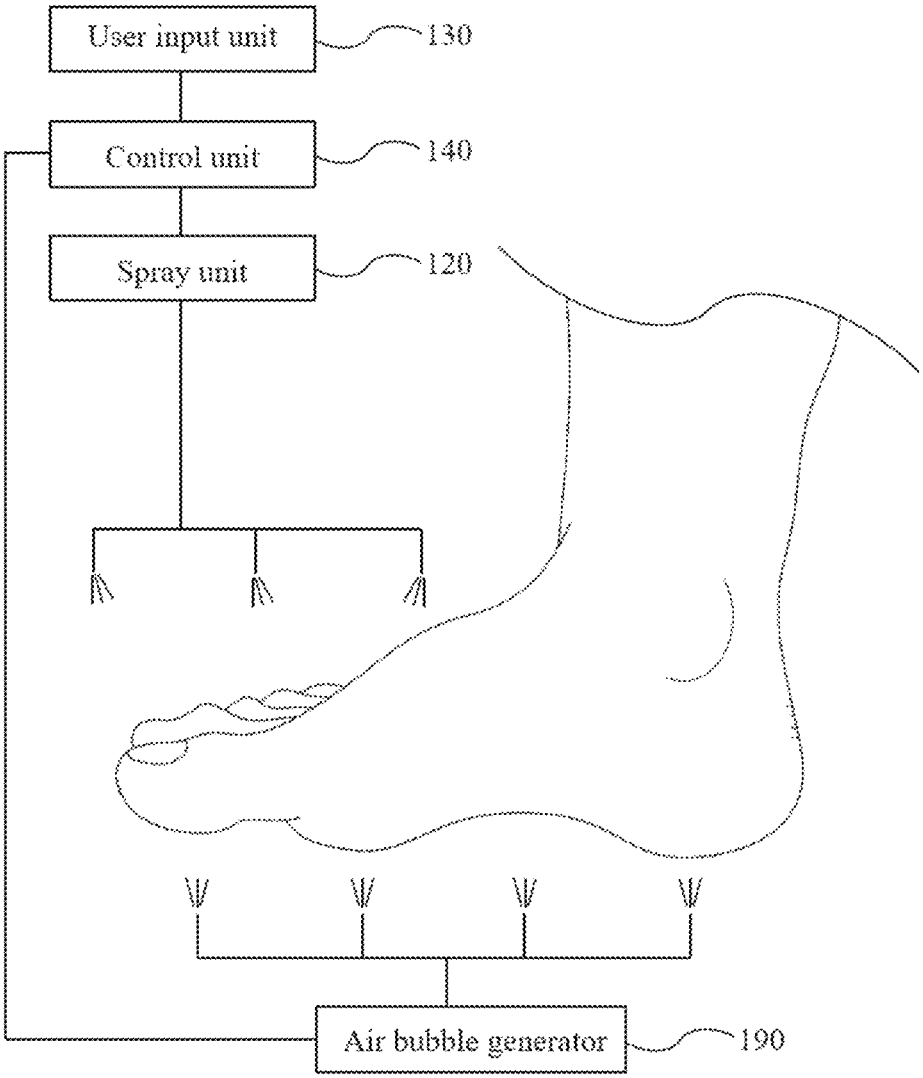
FIG. 15 is a diagram schematically illustrating an example of an operation of an air bubble generator in the sitting toilet to which the foot health care device according to an embodiment of the present disclosure has been attached.

FIG. 15 is a diagram schematically illustrating an example of an operation of an air bubble generator in the sitting toilet to which the foot health care device according to an embodiment of the present disclosure has been attached.

Referring to FIG. 15, the foot health care device (100 in FIGS. 13 and 14) may further include an air bubble generator 190 that is disposed at the bottom of the foot washing bowl (110 in FIGS. 13 and 14) (the bottom of the washing plate) and that generates air bubbles toward a user's sole.

When washing water is sprayed to a corresponding section while air bubbles are generated, cleaning efficiency can be improved and a user can have a feeling of refreshment attributable to air bubbles because the resistance of the water becomes weak.

The air bubble generator 190 adjusts the velocity of gas that is injected so that optimal contact efficiency can be obtained when a solid or a liquid is absorbed or made to react to the gas by bringing the gas into contact with the solid or the liquid, and shapes of air bubbles.

Figure 16:
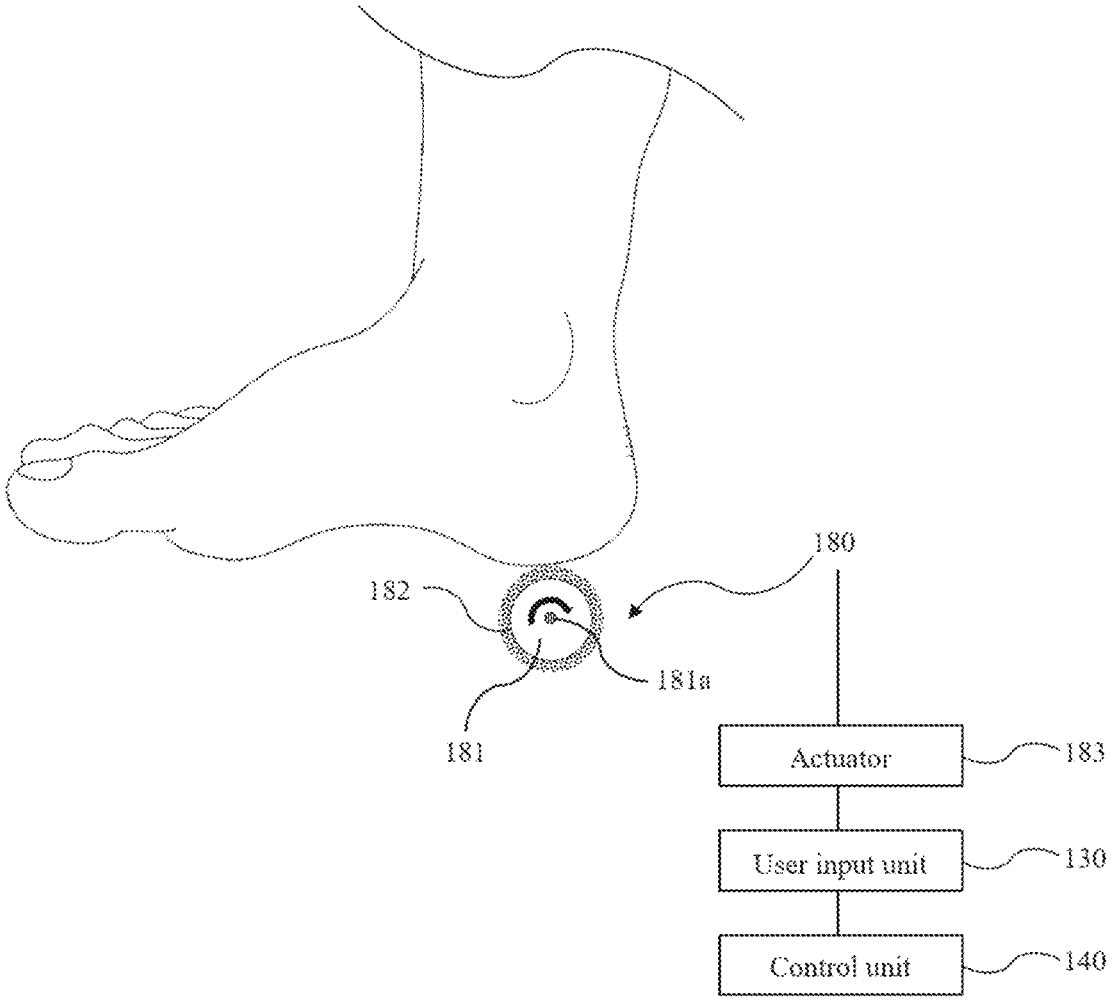
FIG. 16 is a diagram schematically illustrating an example of an operation of a heel washing unit in the sitting toilet having the foot health care device attached thereto according to an embodiment of the present disclosure.

FIG. 16 is a diagram schematically illustrating an example of an operation of a heel washing unit in the sitting toilet having the foot health care device attached thereto according to an embodiment of the present disclosure.

Referring to FIG. 16, the foot health care device (100 in FIGS. 3 to 6) according to the present disclosure may further include a heel washing unit 180.

The heel washing unit 180 is rotatably installed at the rear end (a portion at which the heel of a foot is placed) of the foot health care device 100, and functions to well wash the heel or remove dead skin cells of the heel. The heel washing unit 180 may be disposed to have a predetermined inclination along a shape of the heel.

The heel washing unit 180 includes a rotation member 181, a brush 182, and an actuator 183.

The rotation member 181 has a structure in which the rotation member is rotatably connected to the rear end of the foot washing tank (110 in FIGS. 13 and 14) within the foot washing tank in a width direction or length direction thereof. The rotation member 181 has rotation pins 181*a* at both ends of the rotation member in a length direction thereof.

The brush 182 is a portion that directly touches a part between the toes of a user, and has a structure that surrounds the rotation member 181. An external surface of the brush 182 has a rough surface, and can effectively remove a polluted material (dead skin cells, etc.) between the toes. For convenience of washing, it is better that the brush 182 has a structure detachable from the rotation member 181.

When a command signal of the user input unit 130 that has been manipulated by a user is transmitted to the control unit 140, the actuator 183 may rotate the rotation member 181 by the control unit 140.

Figure 17:
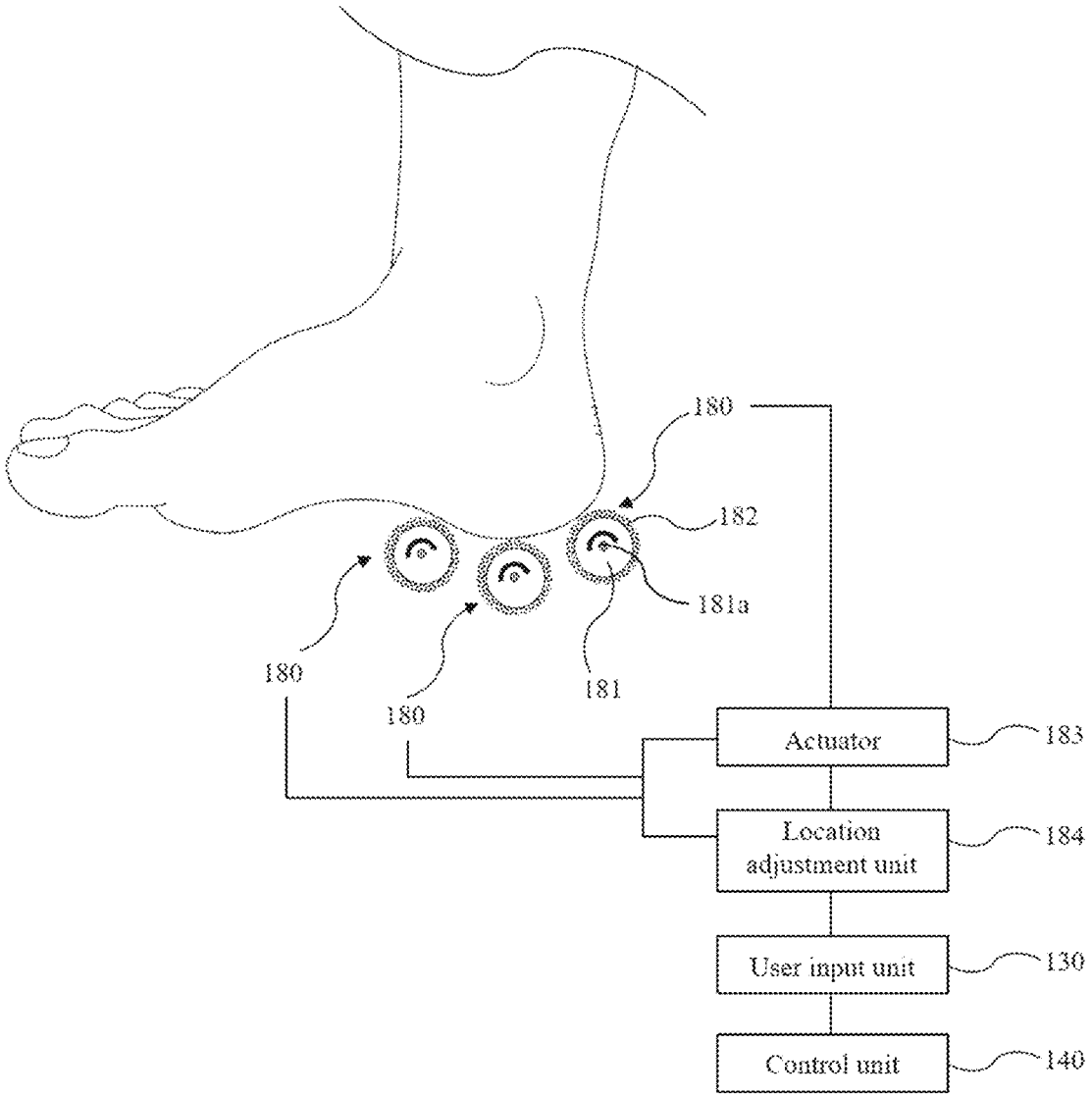
FIG. 17 is a diagram schematically illustrating a modified example of an operation of the heel washing unit in the sitting toilet having the foot health care device attached thereto according to an embodiment of the present disclosure.

FIG. 17 is a diagram schematically illustrating a modified example of an operation of the heel washing unit in the sitting toilet having the foot health care device attached thereto according to an embodiment of the present disclosure.

Referring to FIG. 17, the heel washing unit 180 may be disposed to be inclined at a predetermined angle along a shape of the heel of a foot. Three heel washing units 180 may be constructed to surround the heel.

In this case, the locations of the heel washing units 180 may be adjusted in a horizontal and vertical direction through a location adjustment unit 184. In addition, a driving mechanism among the actuator 183, the user input unit 130, and the control unit 140 is omitted because the driving mechanism is the same as that in FIG. 16.

Meanwhile, as an example of another construction of the heel washing unit 180, one rotation shaft may be constructed to wash the heel and/or ball of a foot while laterally moving in a direction perpendicular to the direction in which the rotation shaft is disposed.

Both the heel washing unit 180 and the washing plate (114 in FIGS. 13 and 14) are disposed at the base (bottom) of the foot washing tank (110 in FIGS. 3 to 6). Accordingly, it is preferred that in order to reduce or remove mutual mechanical interference, the size of the washing plate 114 is reduced and the heel washing unit 180 and the washing plate 114 are spaced apart from each other at a predetermined interval and installed in the remaining space.

As another embodiment, in addition to the heel washing unit 180, a ball-of-foot washing unit (not illustrated) may be further installed at the front end of the foot health care device (100 in FIGS. 3 to 6). The ball-of-foot washing unit has a function for washing and massaging the ball of a foot, which corresponds to a portion between the arch and toes of the foot, and a detailed structure thereof is constructed substantially identically with the heel washing unit.

Additionally, the foot health care device 100 according to the present disclosure may include a heating unit (not illustrated) for heating washing water. The heating unit heats washing water before the washing water is sprayed by using a method, such as a water heater or an electric heater, so that warm washing water is sprayed.

Figure 18:
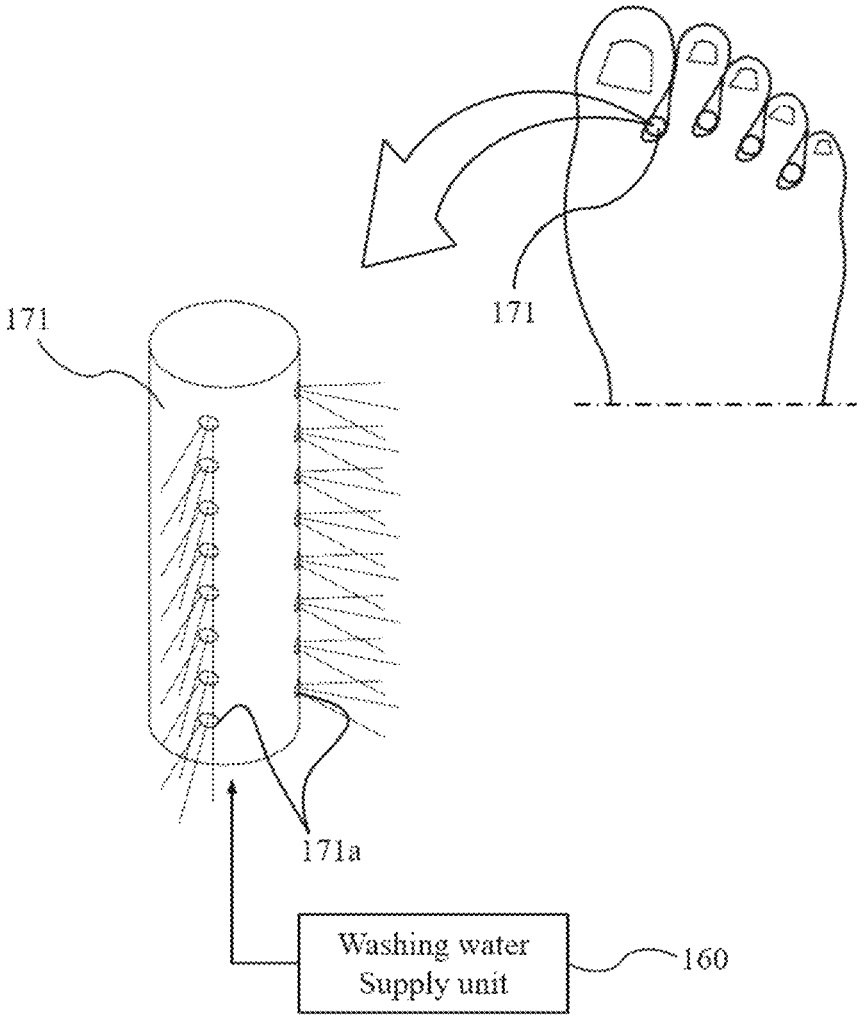
FIG. 18 is a diagram schematically illustrating a toe spray nozzle in the sifting toilet having the foot health care device attached thereto according to an embodiment of the present disclosure.

FIG. 18 is a diagram schematically illustrating a toe spray nozzle in the sitting toilet having the foot health care device attached thereto according to an embodiment of the present disclosure.

Referring to FIG. 18, a toe spray nozzle 171 may be further disposed in the foot health care device.

The toe spray nozzles 171 are disposed at intervals in the width direction of the washing plate 114 so that the toe spray nozzle is disposed between the toes of a foot, which are seated in the washing plate (114 in FIGS. 13 and 14) in a length direction thereof, and spray water between the toes.

The toe spray nozzle 171 is disposed between the toes, and may be constructed in a form in which the width between the toe spray nozzles is adjusted left and right or the length of the toe spray nozzle is adjusted up and down on the basis of toes illustrated in FIG. 18.

The toe spray nozzle 171 has a cylindrical shape, and has a plurality of spray holes 171*a* on an external surface thereof. The toe spray nozzle 171 is connected to the washing water supply unit 160, and has a function for spraying washing water to the outside. The washing water that is supplied by the washing water supply unit 160 is sprayed to the outside (between the toes of a user) through the plurality of spray holes 171*a*.

The toe spray nozzle 171 has a column shape as illustrated, but the toe spray nozzle 171 has a taper shape the width of a part of the top of which is widened from an upper part to a lower part thereof, and may have a structure which can be easily inserted between toes.

The toe spray nozzle 171 may have a structure which can be moved and adjusted up and down and can spray water while rotating.

A person who uses the foot health care device 100 according to the present disclosure has different shapes and sizes of toes. The location of the toe spray nozzle 171 may be moved by a predetermined length (an installation interval) in the width (and/or length) direction of the washing plate 114 depending on a shape of a toe of a user so that the toe spray nozzle can be applied to unspecified individuals.

A location movement of the toe spray nozzle 171 for each user is stored in a memory device (not illustrated) so that the toe spray nozzle can be moved to a location that has been stored for each user by a simple manipulation of the user input unit (130 in FIGS. 4 and 6) subsequently. For example, this may correspond to an example in which if two persons A and B who have different toe sizes and shapes use the foot health care device 100, the person A may manipulate the user input unit (e.g., press a No. 1 button) so that the toe spray nozzle 171 is automatically moved to a location suitable for a toe of the person A and the person B may manipulate the user input unit (e.g., press a No. 2 button) so that the toe spray nozzle 171 is automatically moved to a location suitable for a toe of the person B.

Hereinafter, an operation and control of the foot health care device (100 in FIGS. 3 to 7, 9, 13 and 14) according to the present disclosure are described. An overall operation of an electrical/electronic device of the foot health care device 100 according to the present disclosure, including the spray unit 120, the cleaning solution nozzle 125, and the user input unit (130 in FIGS. 4 to 6), is controlled by the control unit (not illustrated).

First, control of spray pressure and a spray operation is described in detail.

The foot health care device 100 according to the present disclosure may be controlled so that the spray nozzles sequentially perform a spray in order to maintain spray pressure of each spray nozzle at a given level or higher. For example, the foot health care device is controlled so that the upward spray nozzle 124, the side spray nozzle 123, and the toe spray nozzle 171 sequentially operate in order to maintain spray pressure at a given level or higher. If necessary, a booster pump (not illustrated) for raising spray pressure may be used. If proper spray pressure can be maintained, the foot health care device may be controlled so that two or more nozzles simultaneously perform a spray.

Meanwhile, in order to increase a washing massage effect, the foot health care device may be controlled so that each nozzle performs a spray at varying spray pressure over time.

A method of spraying washing water and a cleaning solution may have various combinations. For example, upon spray of washing water by the spray unit 120, the spray unit 120 may be constructed to spray water and a cleaning solution alternately or according to a predetermined spray pattern through the same nozzle, to spray washing water in which water and a cleaning solution are mixed, or to spray only water. Alternatively, the cleaning solution may be controlled to be sprayed by only a dedicated nozzle (the cleaning solution nozzle 125).

In order to increase a washing effect and a massage effect, the spray angle of each nozzle of the spray unit 120 may be adjusted left/right or up/down. It is preferred that the spray angles of the side spray nozzle 123 and the upward spray nozzle 124 are limited in a predetermined range so that water is not splashed out of the foot washing tank 110.

Control of spray pressure, a spray method, and a spray angle is performed by the control unit (140 in FIGS. 4 to 6) according to a user manipulation through the user input unit (130 in FIGS. 4 to 6) or preset control logic.

Figure 19:
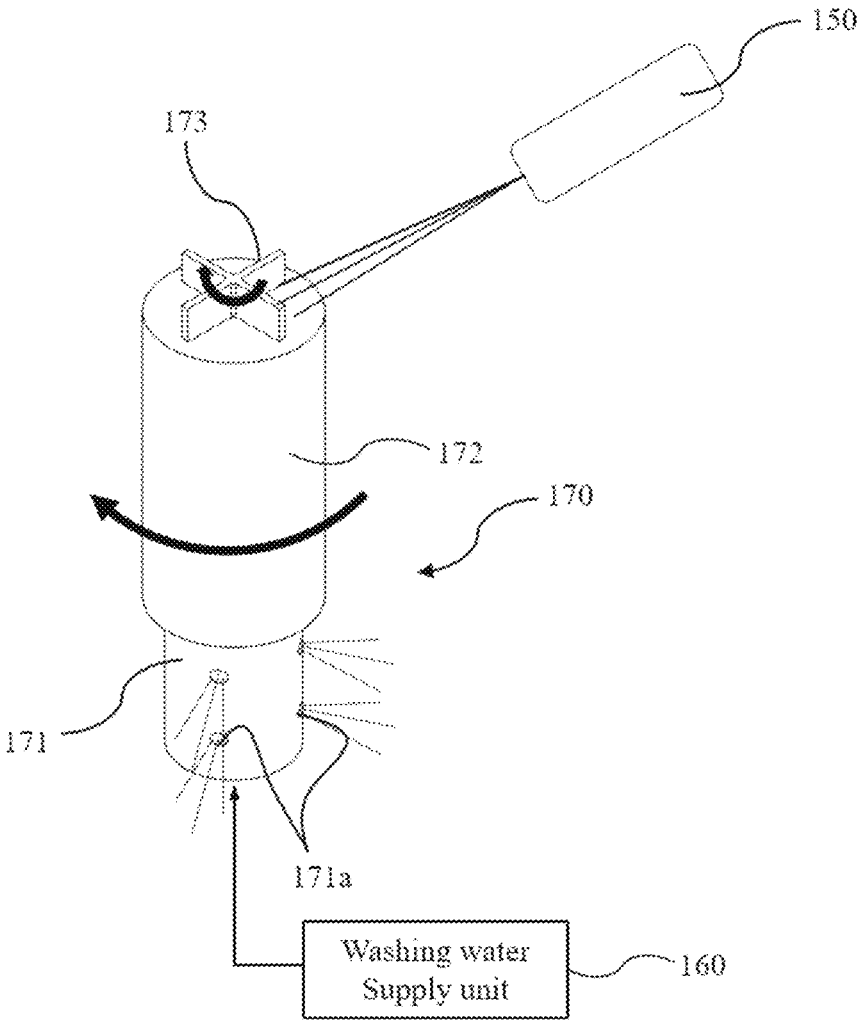
FIG. 19 is a diagram schematically illustrating an example of an operation of a toe washing unit in the sitting toilet having the foot health care device attached thereto according to an embodiment of the present disclosure.

FIG. 19 is a diagram schematically illustrating an example of an operation of a toe washing unit in the sitting toilet having the foot health care device attached thereto according to an embodiment of the present disclosure.

Referring to FIG. 19, a toe washing unit 170 includes the toe spray nozzle 171, a washing member 172, and a rotation piece 173.

The washing member 172 may be rotatably mounted on the top of the toe spray nozzle 171. The washing member 172 has a cylindrical shape the bottom of which is opened. The rotation piece 173 is disposed at the top of the washing member 172, and may be coaxially rotated along with the washing member 172.

In the toe washing unit 170, the washing member 172 combined with the rotation piece 173 covers a part of the top of the toe spray nozzle 171, and washes between toes while rotating in an axial direction. That is, the washing member 172 has a structure in which the washing member is rotated while operating in conjunction with the rotation piece 173, when the rotation piece 173 is rotated by washing water that is sprayed by the spray unit 120.

The washing member 172 is a portion that directly touches the skin in order to remove an alien substance, including various types of dead skin cells, etc., between the toes. Accordingly, the washing member may have a rubber type that is produced by blowing an undiluted solution of natural rubber, or may be made of a hard sponge consisting of a urethane type that is made of synthetic resin. A plurality of bumps may be formed in an outer circumference surface of the washing member 172 at intervals.

In this case, a bearing (not illustrated) that assists the rotation of the washing member 172 may be provided between an inner circumferential surface of the washing member 172 and an outer circumference surface of the toe spray nozzle 171.

FIGS. 20 to 23 are diagrams schematically illustrating modified examples of an operation of the toe washing unit in the sitting toilet having the foot health care device attached thereto according to an embodiment of the present disclosure.

A washing member 172' illustrated in FIGS. 20 to 23 has a cylindrical shape the bottom of which is opened, and may be rotated in an axial direction thereof in the state in which the washing member has surrounded the outside of a toe spray nozzle 171'. However, the washing member 172' in FIGS. 20 to 23 has a rotation method different from that of the aforementioned embodiment.

Prior to a description of the rotation method, structures of the toe spray nozzle 171' and the washing member 172' are described.

Figure 21:
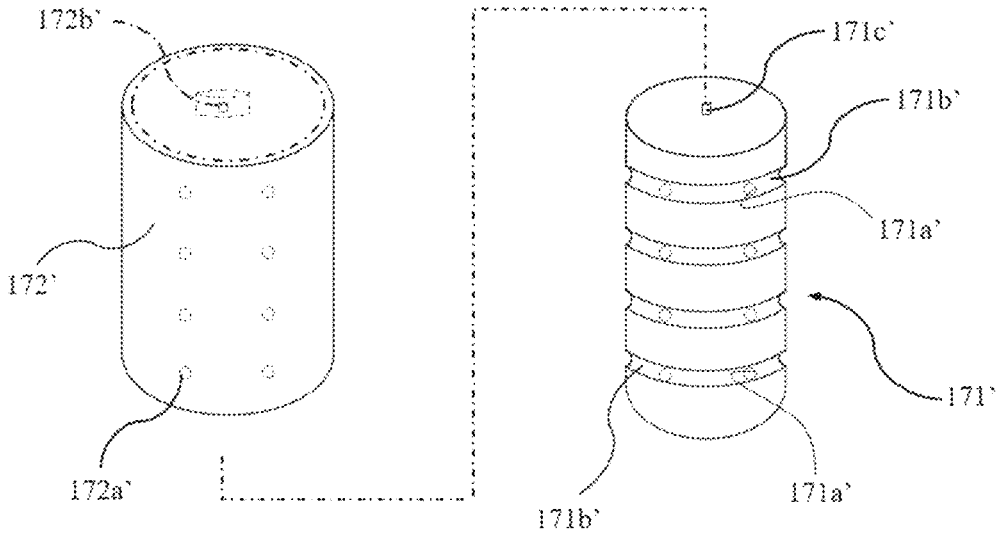

As illustrated in FIG. 21, the toe spray nozzle 171' has a structure in which the toe spray nozzle can be rotated in the state in which the toe spray nozzle has been inserted into the washing member 172'.

To this end, the toe spray nozzle 171' has a washing water guide groove 171*b'*, a spray hole 171*a'*, and a rotation shaft 171*c'*. The washing water guide grooves 171*b'* are depressed and formed at intervals on the outer circumferential surface of the toe spray nozzle 171' in a length direction thereof. The spray holes 171*a'* are formed in the washing water guide groove 171*b'* at intervals in a way to penetrate the washing water guide groove 171*b'*. The rotation shaft 171*c'* is connected to a rotation shaft connection groove 172*b'* that is formed on the inner surface of the washing member 172'.

The washing member 172' has a plurality of spray holes 172*a'* that communicate with the spray holes 171*a'* of the toe spray nozzle 171'.

Figure 20:
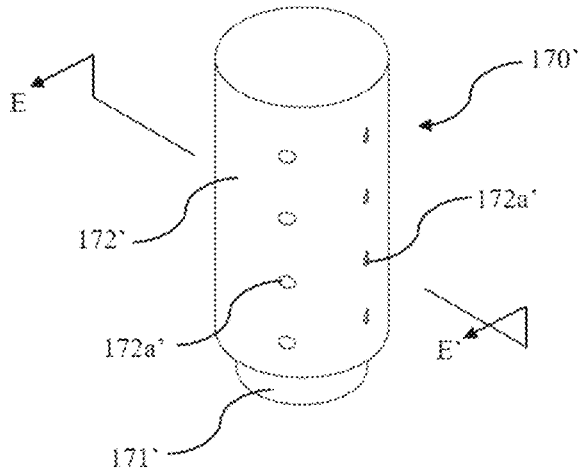
FIGS. 20 to 23 are diagrams schematically illustrating modified examples of an operation of the toe washing unit in the sifting toilet having the foot health care device attached thereto according to an embodiment of the present disclosure.
Figure 22A:
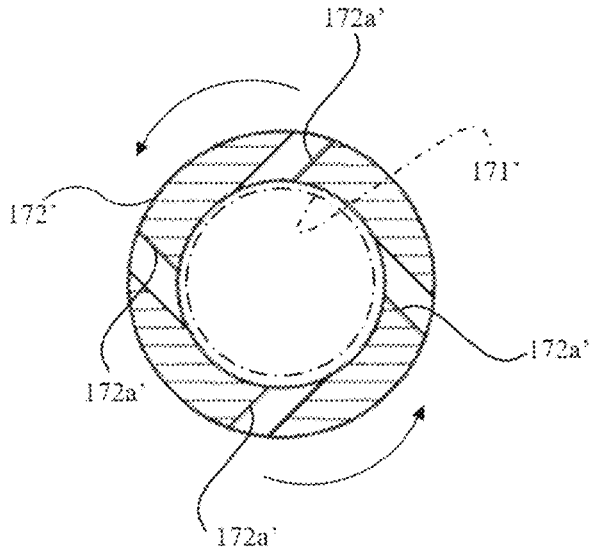
Figure 22B:
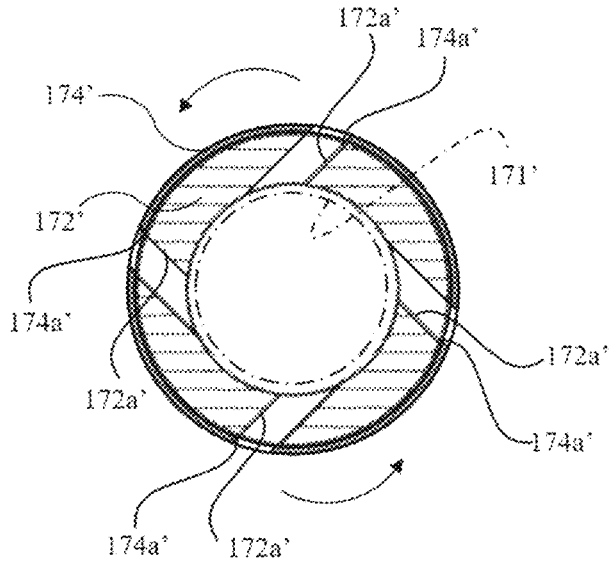

FIG. 22A is a diagram illustrating the cross section E-E' in FIG. 20, and FIG. 22B thereof is an example in which a washing member cover 174' has been added in FIG. 22A. Referring to FIGS. 22A and 22B, the spray hole 172*a'* has a structure in which the spray hole is slantly penetrated on the basis of the shaft center of the washing member 172'.

The spray hole 172*a'* of the washing member 172' has a structure in which the spray hole is connected to the washing water guide groove 171*b'* of the toe spray nozzle 171'.

In this case, the washing water guide groove 171*b'* is a space through which water flows, and has a function for continuously spraying, to the outside, washing water that is input to the washing member 172' via the toe spray nozzle 171' seamlessly.

Figure 23:
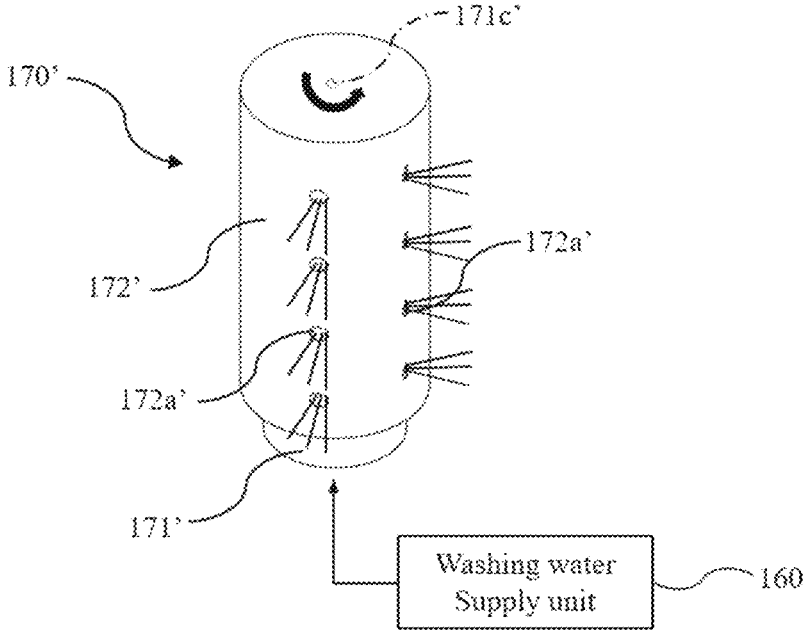

As illustrated in FIG. 23, when washing water supplied by the washing water supply unit 160 is sprayed to the spray hole 172*a'* via the spray hole 171*a'* of the toe spray nozzle 171', the spray hole 172*a'* induces the rotation of the washing member 172' by its spray pressure.

The washing member 172' has a structure that is rotated by the force of washing water that is spouted through the spray hole 172*a'*. If the washing member 172' is made of a soft material, the washing member 172' may not be rotated between the toes of a user. Accordingly, the washing member 172' is made of a hard material in a range in which the washing member can be rotated. A plurality of bumps may be formed in the outer surface of the washing member in order to assist washing.

The washing member cover 174' may be replaced with a shape that is inserted into the outer circumference surface of the washing member 172'. That is, the washing member cover 174' has a replacement type in order to maintain cleanliness because a contact surface of the washing member cover may be contaminated when a polluted material between the toes of a user is removed. In this case, it is preferred that a cover hole 174*a'* of the washing member cover 174' communicates with the spray hole 172*a'*.

In the toe washing unit 170', the toe washing nozzle 171' is perpendicularly extended upward. One or more toe washing nozzles 171' are disposed every between toes of a user, and wash between the toes and massage the toes through its rotation.

It is better that one or more bumps are placed in the outer circumference surface of the washing member 172' that surrounds the toe washing nozzle 171' in order to increase cleaning power and a massage effect. It is better that the body itself of the washing member 172' is a hard material, but the bump is a soft material.

Hereinafter, a preferred embodiment of an automatic washing operation of the foot health care device 100 according to the present disclosure is described.

The automatic washing function may include a foot placement detection step, a cleaning solution spray step, and a foot washing step. The foot placement detection step is a step of detecting that a foot is placed in the washing plate 114. The cleaning solution spray step is a step of spraying, by the control unit, a cleaning solution, by receiving a location information value of a foot detected by a foot detection sensor (not illustrated) and driving the cleaning solution nozzle 125 of the spray unit 120. The foot washing step is a step of washing the foot by spraying water through a water spray nozzle unit when a first waiting time elapses after the cleaning solution is sprayed.

Optionally, a foot detachment detection step of detecting, by the foot detection sensor, that the foot has been detached from the washing plate 114 and an internal washing step of spraying, by the spray unit 120, washing water in order to wash an internal space of the foot washing tank 110 after a second waiting time elapses may be additionally constructed.

In this case, the first or second waiting time means a preset time in a corresponding process, and a corresponding time may be changed by a user.

A user may perform various pre-settings by using the user input unit (130 in FIGS. 4 and 6). A user may set basic values, such as spray pressure of the spray unit 120, the first waiting time and second waiting time of the automatic washing function, and the injection quantity of a cleaning solution.

The foot placement detection step is performed by the foot detection sensor.

The foot detection sensor may be implemented in a way to install a light-receiving unit (not illustrated) and a light-emitting unit (not illustrated) on inner walls of the foot washing tank 110 on the left and right thereof, or may be implemented by placing a pressure sensor at the bottom of the washing plate 114.

The foot detection sensor transmits, to the control unit, an information value obtained by detecting a location at which a foot approaches the washing plate 114 or a pressure value at which the foot has been seated in the washing plate 114. The control unit is electrically connected to the foot detection sensor, and compares and computes a preset reference value and the information value transmitted by the foot detection sensor. When a result value complies with a reference value, the control unit drives and controls the spray unit 120.

In the foot washing step, the control unit controls the spray unit 120 so that an inner reception space of the foot washing tank 110 is automatically washed for a preset time. In this case, the preset time is a time that is calculated based on statistical values that have been accumulated as various types of data. An initial setting value may be different depending on each function, and a setting value thereof may be determined by a user. In order to increase a foot washing effect, foot washing may be performed while automatically changing a method of spraying washing water and a cleaning solution, spray pressure, and a spray angle in response to a user input or according to preset logic.

The internal washing step is performed when a user who has finished foot washing pulls out the foot. When the foot being detached from the washing plate 114 is detected, the driving of the spray unit 120 is stopped by the control unit. The control unit controls the spray unit 120 to wash the inside of the foot washing tank 110 by using the automatic washing function.

In order to wash the inside of the foot health care device 100, the control unit sprays washing water toward the washing plate 114 for a preset time by adjusting a spray angle. The set time may be arbitrarily changed by a user. Alternatively, the degree of washing of the washing plate may be detected by using a contamination sensor (not illustrated), and a washing time for the washing plate may be changed until washing having a proper level is reached.

Washing water that is sprayed in the internal washing step may be a mixture of a cleaning solution having stronger cleaning power than washing water upon washing of a foot.

To this end, a cleaning solution storage unit may be constructed to store a cleaning solution for washing plate washing, separately from a cleaning solution for foot washing.

The construction of the present disclosure has been described above in detail through some preferred embodiments. The present disclosure has the structure capable of evenly washing the sole of a foot and between the toes of the foot even without using a hand without bending the waist. Accordingly, even a disabled person having a limited movement can conveniently wash his or her foot.

Furthermore, the foot health care device has the function for automatically washing the device after a foot washing and a foot bath, and thus can solve a conventional management problem. In this case, the foot health care device that has performed the foot washing and foot bath on the user may have an ultraviolet lamp (not illustrated) or a dry device (not illustrated) constructed within the cover of the body part, and may wipe out germs or remove moisture.

Figure 24:
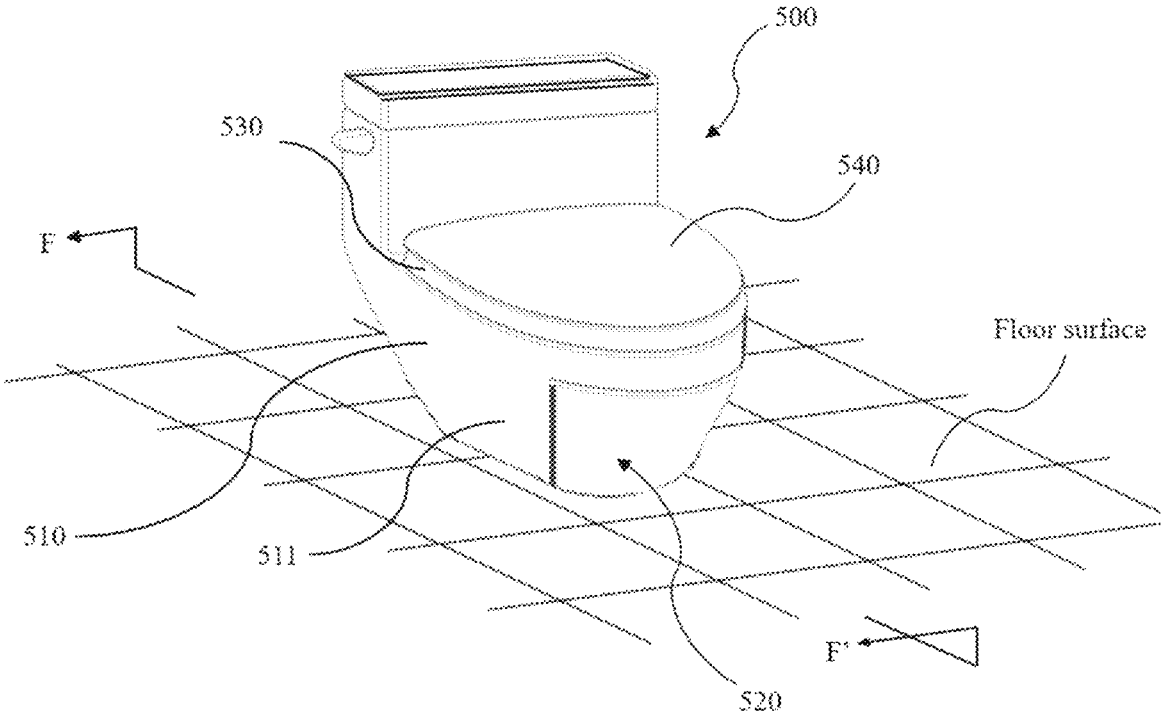
FIG. 24 is a diagram schematically illustrating a sifting toilet having a foot health care device attached thereto according to an embodiment of the present disclosure.
Figure 25:
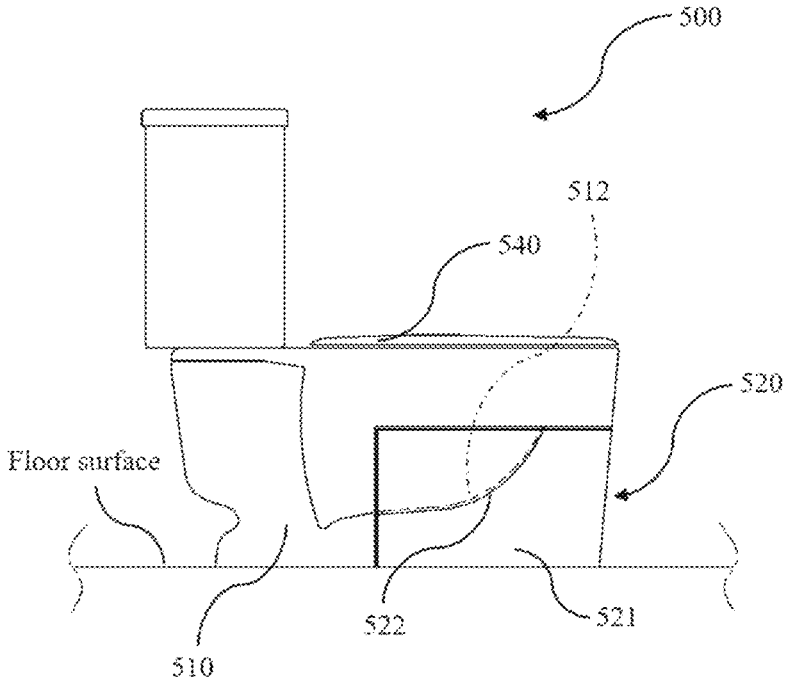
FIGS. 25 and 26 are side views schematically illustrating a coupling structure of a foot washing tank taken along line F-F' indicated in FIG. 24.
Figure 26:
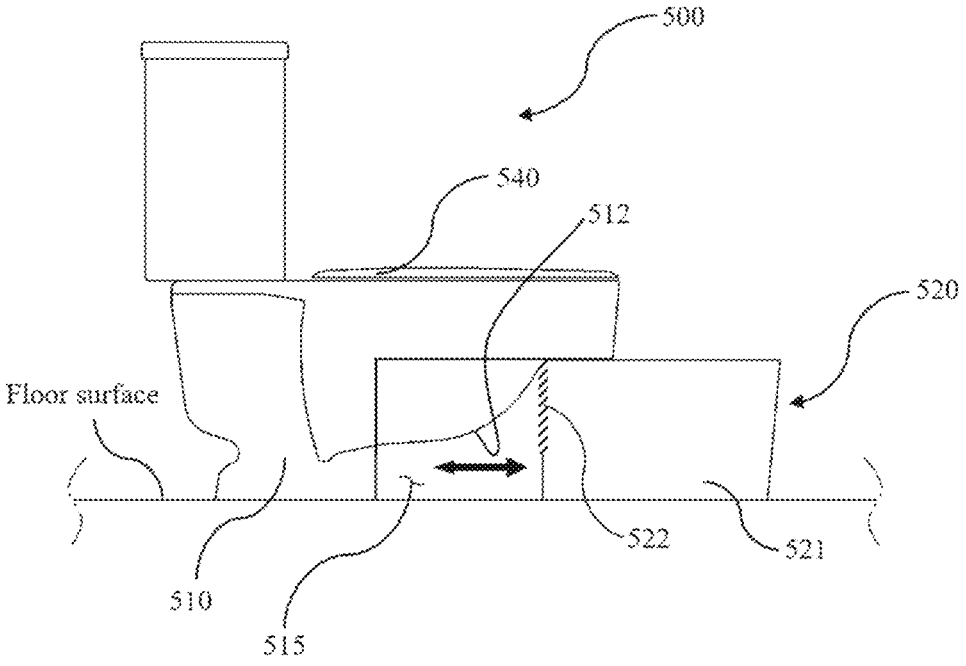
Figure 27:
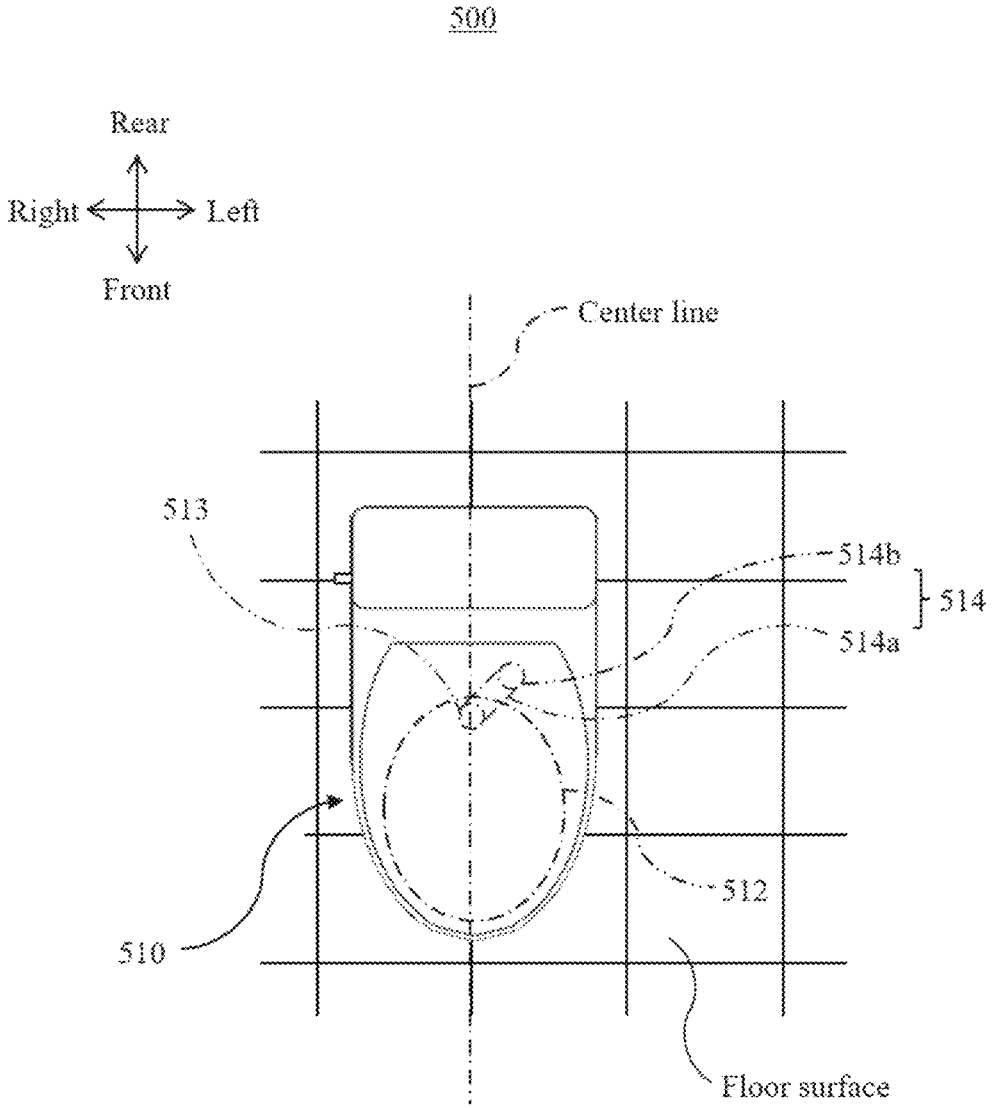
FIG. 27 is a plan view schematically illustrating a wastewater discharge unit of a sifting toilet according to another embodiment of the present disclosure.
Figure 28:
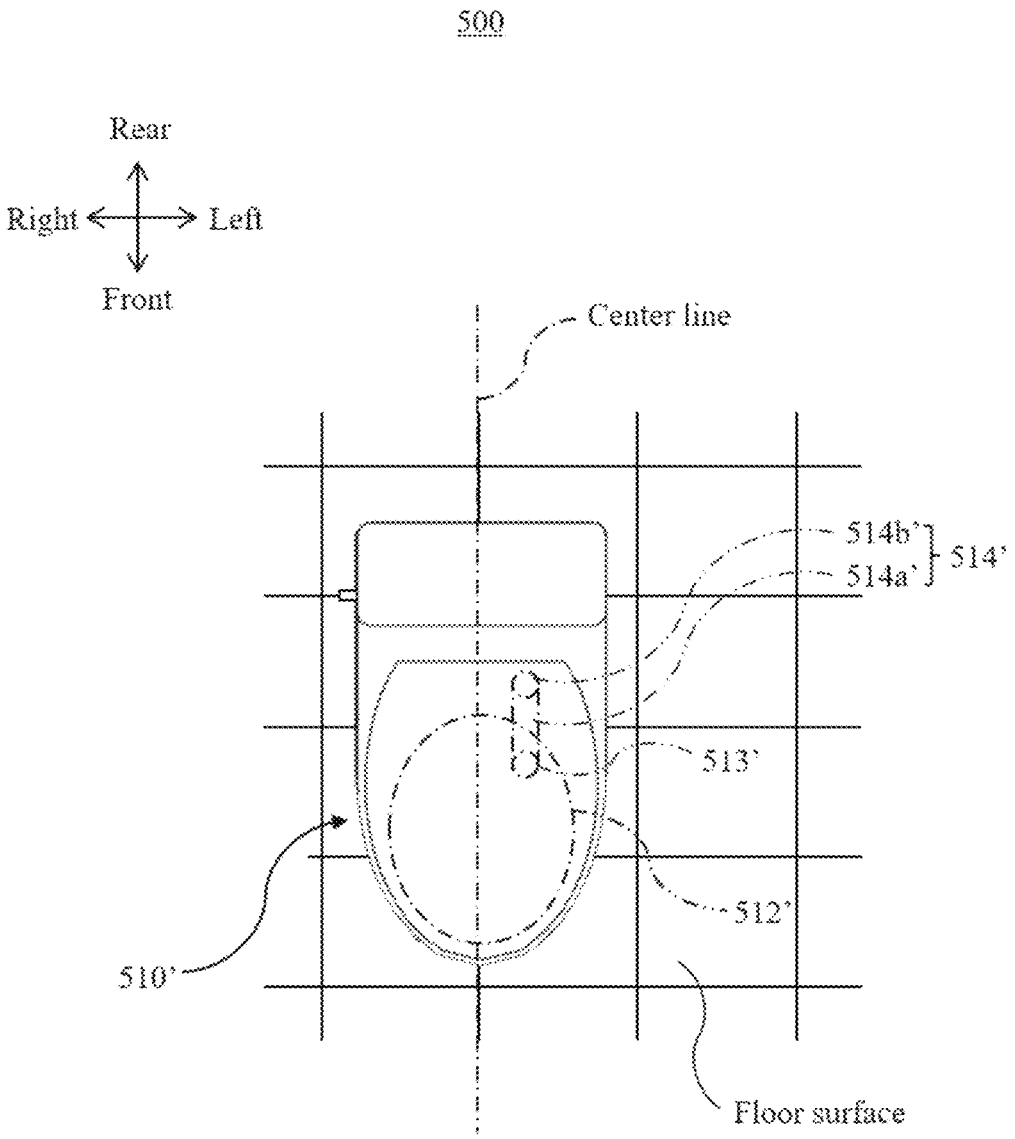
FIG. 28 is a plan view schematically illustrating a modified example of a toilet bowl and a wastewater discharge unit in a sifting toilet according to another embodiment of the present disclosure.

FIG. 24 is a diagram schematically illustrating a sitting toilet having a foot health care device attached thereto according to an embodiment of the present disclosure. FIGS. 25 and 26 are side views schematically illustrating a coupling structure of a foot washing tank taken along line F-F' indicated in FIG. 24. FIG. 27 is a plan view schematically illustrating a wastewater discharge unit of a sitting toilet according to another embodiment of the present disclosure. FIG. 28 is a plan view schematically illustrating a modified example of a toilet bowl and a wastewater discharge unit in a sitting toilet according to another embodiment of the present disclosure.

As illustrated in FIGS. 24 to 28, unlike the aforementioned sitting toilet 10, a sitting toilet 500 according to another embodiment of the present disclosure has a structure in which a foot health care device 520 is attached to the sitting toilet in a sliding way. In this case, the foot health care device 520 has the same functional characteristics as the aforementioned foot health care device 100. Accordingly, only a portion that is structurally different is described, and a description of the remaining same portions is omitted.

Basically, the foot health care device 520 may slide and move forward and backward from a receiving part 515 within the sitting toilet 500.

For example, a sliding rail (not illustrated) and a caster (not illustrated) capable of moving on the sliding rail may be provided at the top and bottom of the foot washing tank 521 and a connection portion within the main body 510. It is better that the sliding rail has a length corresponding to a path along which the foot washing tank 521 is movable from the front of the foot washing tank 521 to the back of the foot washing tank 521 and vice versa, for a stable sliding movement of the foot washing tank 521. A stopper (not illustrated) may be provided every unit length on the sliding rail so that the foot washing tank 521 is stably stopped.

The foot washing tank 521 may have a structure in which the foot washing tank is slid and moved by electricity through an electric linear actuator (not illustrated) within the main body 510. As another embodiment, the foot washing tank 521 may have a structure in which the foot washing tank is manually slid.

In this case, a variable wall body 522 that is formed in the inner wall of a foot washing bowl 521 is a portion that is in contact with the bottom of the toilet bowl 512, and is made of a material a shape of which can be variably deformed suitably for a shape of the bottom of the toilet bowl 512.

Meanwhile, in order to install the aforementioned sliding-related part in the receiving part 515 formed under the toilet bowl 512, a sufficient space needs to be secured.

To this end, as illustrated in FIG. 27, the sitting toilet 500 is constructed so that a wastewater discharge unit 514 at a location close to a sliding-related part is eccentrically disposed on any one side on the basis of the left and right center line of the toilet bowl 512. In this case, the toilet bowl 512 is symmetrically formed on the basis of the left and right center line. In order to further secure a space, however, a wastewater outlet 513' of a toilet bowl 512' may be eccentrically disposed asymmetrically, as illustrated in FIG. 28.

In this case, the sitting toilet 500 can secure a space in which a sliding-related part can be installed by also eccentrically disposing a wastewater discharge unit 514' connected to the wastewater outlet 513' of the toilet bowl 512' on the same side as the toilet bowl 512'.

The present disclosure is not limited to the aforementioned embodiments, and may be modified and implemented in various ways without departing from the technical spirit of the present disclosure.

INDUSTRIAL APPLICABILITY

As described above, the embodiments of the present disclosure may combine even foot washing and a massage in the state in which a user has been seated in a toilet, in addition to a function as the toilet even in a narrow space.

The invention claimed is:

1. A sitting toilet comprising:

a main body having a receiving part in parts of a bottom of the main body at a front thereof and the bottom of the main body at a rear thereof; and a foot health care device held in the receiving part of the main body and comprising a hinge located at a lower portion of the foot health care device, wherein the main body comprises:

a toilet bowl formed across a top of the main body at the front thereof and the rear part of the main body and comprising a wastewater outlet on a center line, which connects a front and rear of the sitting toilet; and a wastewater discharge unit connected to the wastewater outlet of the toilet bowl, eccentrically disposed away from the center line, and configured to discharge wastewater to an outside, and wherein the foot health care device is movable, by user manipulation, between an upright stowed position and a horizontal deployed position, such that the foot health care device rotates around the hinge forward to the horizontal deployed position and backward to the upright stowed position.

2. The sitting toilet of claim 1, wherein the wastewater discharge unit comprises:

a trap connected to the wastewater outlet of the toilet bowl and disposed in an eccentric direction away from the center line; and an external wastewater pipe connection part connected to the trap, disposed in the same eccentric direction as the trap away from the center line, and configured to discharge wastewater to the outside.

3. The sitting toilet of claim 1, wherein the foot health care device is slid and adjusted from the receiving part of the main body to the front and rear of the main body so that an inside space of a foot washing bowl in which user's feet are placed is opened and closed.

4. The sitting toilet of claim 1, wherein the foot health care device comprises:

a foot washing bowl having an inside space in which user's feet are placed;

a user input unit configured to provide various types of function buttons; and a driving unit configured to unfold and adjust the foot washing bowl forward and backward in response to an instruction signal from the user input unit, wherein the foot washing bowl is set by default so that the foot washing bowl is folded and held in the receiving part of the main body, and is able to be slid and moved and rotatably moved and unfolded and adjusted to the front and rear of the main body in response to a user's manipulation.

5. The sitting toilet of claim 4, wherein the foot health care device comprises:

a spray unit configured to spray predetermined washing water toward an inside space of the foot washing bowl;

a foot detection sensor configured to detect locations of the user's feet which are placed in the inside space of the foot washing bowl; and a control unit configured to adjust a spray angle of the spray unit based on the locations of the user's feet, which are detected in the foot detection sensor.

6. The sitting toilet of claim 5, wherein:

the foot health care device further comprises an air bubble generator disposed at a bottom of the foot washing bowl and configured to generate air bubbles, and the spray unit sprays the washing water in a state in which the air bubble generator has been turned on.

7. The sitting toilet of claim 5, wherein:

the foot washing bowl of the foot health care device further comprises a toe washing unit configured to wash toes of the user, which are placed in the inside space, and the toe washing unit comprises:

a toe spray nozzle configured to spray the washing water between the toes of the user, and a washing member attached to an outside of the toe spray nozzle and configured to remove contaminants between the toes of the user.

8. The sitting toilet of claim 5, wherein the spray unit comprises:

one or more side spray nozzles disposed in an inner circumferential surface of the foot washing bowl and configured to spray water laterally, and an upward spray nozzle installed at a bottom of the foot washing bowl and configured to spray water upward, wherein a nozzle disposed at a front end, among the side spray nozzles, is disposed to be higher than a nozzle disposed at a rear end, among the side spray nozzles.

9. The sitting toilet of claim 8, wherein the spray unit further comprises:

a downward spray nozzle configured to spray water toward an inner floor of the foot washing bowl;

a cleaning solution nozzle disposed inside the foot washing bowl and configured to spray a cleaning solution; and a spray valve connected between the downward spray nozzle and the cleaning solution nozzle and capable of selectively adjusting the spray of the downward spray nozzle and the cleaning solution nozzle.

10. The sitting toilet of claim 5, wherein:

the foot health care device further comprises a heel washing unit rotatably installed at a rear end of the foot washing bowl therein and configured to wash a heel of the user, and the heel washing unit is disposed to have a predetermined inclination along a shape of the heel of the foot.

11. The sitting toilet of claim 10, wherein the heel washing unit comprises:

a rotation member connected to the rear end of the foot washing bowl therein in a width direction or length direction thereof and having a rotatable structure;

a detachable type brush having a structure surrounding the rotation member and comprising an external surface having a rough surface; and an actuator configured to rotate the rotation member by the control unit.

12. The sitting toilet of claim 11, wherein the heel washing unit comprises a location adjustment part configured to adjust a location of the rotation member by the control unit.

13. The sitting toilet of claim 1, wherein an outer wall configured to airtightly protect a moving section of the foot washing bowl and support the a-front of the main body is disposed at both ends of the receiving part of the main body.

14. The sitting toilet of claim 13, wherein:

an inner wall is disposed inside the receiving part of the main body, and a sealing structure is provided between a bottom of the inner wall and a bathroom floor so that bad smell is blocked from being introduced from the wastewater outlet of the bathroom floor to a room.

15. A sitting toilet comprising:

a main body having a receiving part in parts of a bottom of the main body at a front thereof and the bottom of the main body at a rear thereof; and a foot health care device held in the receiving part of the main body and comprising a hinge located at a lower portion of the foot health care device, wherein the main body comprises:

a toilet bowl formed across a top of the main body at the front thereof and the rear part of the main body and comprising a wastewater outlet that is eccentrically disposed on any one of left and right sides on the basis of a center line, which connects a front and rear of a center of the sitting toilet; and a wastewater discharge unit connected to the wastewater outlet of the toilet bowl, eccentrically disposed from the center line on the same side as the wastewater outlet of the toilet bowl, and configured to discharge wastewater to an outside, and wherein the foot health care device is movable, by user manipulation, between an upright stowed position and a horizontal deployed position, such that the foot health care device rotates around the hinge forward to the horizontal deployed position and backward to the upright stowed position.

16. The sitting toilet of claim 15, wherein the wastewater discharge unit comprises:

a trap connected to the wastewater outlet of the toilet bowl and eccentrically disposed from the center line on the same side as the wastewater outlet of the toilet bowl; and an external wastewater pipe connection part connected to the trap, eccentrically disposed from the center line on the same side as the wastewater outlet of the toilet bowl, and configured to discharge wastewater to the outside.

17. A sitting toilet comprising:

a main body having a receiving part in parts of a bottom of the main body at a front thereof and the bottom of the main body at a rear thereof; and a foot health care device held in the receiving part of the main body and capable of being unfolded and adjusted in response to a user's manipulation, wherein the main body comprises:

a toilet bowl formed across a top of the main body at the front thereof and the rear part of the main body and comprising a wastewater outlet on a center line, which connects a front and rear of the sitting toilet; and a wastewater discharge unit connected to the wastewater outlet of the toilet bowl. eccentrically disposed away from the center line, and configured to discharge wastewater to an outside, wherein the foot health care device comprises:

a foot washing bowl having an inside space in which user's feet are placed;

a user input unit configured to provide various types of function buttons; and a driving unit configured to unfold and adjust the foot washing bowl forward and backward in response to an instruction signal from the user input unit, wherein the foot washing bowl is set by default so that the foot washing bowl is folded and held in the receiving part of the main body, and is able to be slid and moved and rotatably moved and unfolded and adjusted to the front and rear of the main body in response to a user's manipulation, wherein:

when the foot washing bowl is held in the receiving part of the main body, an internal box is maintained in a state in which the internal box has been folded within an external box that forms an outward appearance of the foot washing bowl, and when the foot washing bowl is unfolded from the main body, the external box is rotatably moved, seated in a floor, and then forward moved horizontally, so that the internal box moves upward from the external box.

18. The sitting toilet of claim 17, wherein a connection part of a rubber material having elasticity is airtightly provided between the internal and external boxes.

19. The sitting toilet of claim 17, wherein the internal and external boxes comprise:

variable wall bodies elastically deformed in accordance with a bottom of the toilet bowl at portions being in contact with the bottom of the toilet bowl when the foot washing bowl is held in the receiving part of the main body, and fixing wall bodies disposed at portions not being contact with the bottom of the toilet bowl and airtightly connected to both ends of the variable wall body.

* * * * *